US010494145B2

(12) United States Patent
Hudson et al.

(10) Patent No.: US 10,494,145 B2
(45) Date of Patent: Dec. 3, 2019

(54) STORAGE CONTAINER WITH SPOUT

(71) Applicant: THE SHERWIN-WILLIAMS COMPANY, Cleveland, OH (US)

(72) Inventors: Richard D. Hudson, North Olmsted, OH (US); James J. Johnson, Akron, OH (US); Gustavo A. Morales, Brunswick, OH (US); Edward Ray Goodwin, Jr., Westlake, OH (US); Michael C. Lambertson, Jr., Aurora, OH (US); Charles T. Buckel, Jr., Valley City, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 14 days.

(21) Appl. No.: 15/465,354

(22) Filed: Mar. 21, 2017

(65) Prior Publication Data

US 2017/0267409 A1 Sep. 21, 2017

Related U.S. Application Data

(60) Provisional application No. 62/373,032, filed on Aug. 10, 2016, provisional application No. 62/356,812, (Continued)

(51) Int. Cl.

| | |
|---|---|
| ***B65D 25/42*** | (2006.01) |
| ***B44D 3/12*** | (2006.01) |
| ***B65D 25/28*** | (2006.01) |
| ***B65D 43/02*** | (2006.01) |
| ***B65D 23/10*** | (2006.01) |

(Continued)

(52) U.S. Cl.

CPC ..... *B65D 25/42* (2013.01); *B44D 3/127* (2013.01); *B44D 3/128* (2013.01); *B65D 1/04* (2013.01); *B65D 1/20* (2013.01); *B65D 3/12* (2013.01); *B65D 23/102* (2013.01); *B65D 25/2864* (2013.01); *B65D 25/2885* (2013.01); *B65D 43/0225* (2013.01); *B65D 47/122* (2013.01)

(58) Field of Classification Search

CPC ..... B65D 25/42; B44D 3/122; B44D 3/12
USPC ..... 222/153.02, 485, 572; D9/528
See application file for complete search history.

(56) References Cited

U.S. PATENT DOCUMENTS 4,488,584 A * 12/1984 Hestehave ..... B65D 25/20 141/331
4,823,947 A * 4/1989 Maynard, Jr. ..... B01D 41/04 141/98

(Continued)

FOREIGN PATENT DOCUMENTS

| | | |
|---|---|---|
| DE | 7428013 | 7/1975 |
| DE | 9001544 | 4/1990 |
| WO | 9113811 | 9/1991 |

*Primary Examiner* — Jeremy Carroll
(74) *Attorney, Agent, or Firm* — Tucker Ellis LLP

(57) ABSTRACT

A storage container with a spout is provided that can store a coating material. The storage container can include a container body having a shape, which may be a circular shape, polygonal shape, or a rounded-polygonal shape. The container body includes a side wall having first and second ends. The storage container with a spout can include a first opening with a corresponding lid and the spout providing a second opening with a corresponding cap. The storage container can further include a handle formed with an aperture through a side of the container body.

20 Claims, 45 Drawing Sheets

Related U.S. Application Data filed on Jun. 30, 2016, provisional application No. 62/313,282, filed on Mar. 25, 2016, provisional application No. 62/311,078, filed on Mar. 21, 2016.

(51) Int. Cl.

| | |
|---|---|
| ***B65D 1/20*** | (2006.01) |
| ***B65D 47/12*** | (2006.01) |
| ***B65D 1/04*** | (2006.01) |
| ***B65D 3/12*** | (2006.01) |

(56) References Cited

U.S. PATENT DOCUMENTS

| | | | | | |
|---|---|---|---|---|---|
| 4,893,723 | A * | 1/1990 | Seabolt | B44D 3/12 | 220/570 |
| 5,054,661 | A * | 10/1991 | Hollje | B44D 3/12 | 15/257.05 |
| D340,189 | S | 10/1993 | Fletcher | | |
| 5,564,525 | A * | 10/1996 | Dunnegan | F01M 11/0458 | 141/98 |
| D378,494 | S | 3/1997 | Miller | | |
| 5,727,708 | A * | 3/1998 | Erickson | B44D 3/12 | 206/514 |
| 5,855,304 | A | 1/1999 | Dean | | |
| D431,472 | S | 10/2000 | Cain | | |
| 6,260,730 | B1 * | 7/2001 | Fellman | B44D 3/12 | 220/23.83 |
| D460,845 | S | 7/2002 | Bergman | | |
| 6,708,838 | B2 | 3/2004 | Bergman | | |
| D505,076 | S | 5/2005 | Logan | | |
| D623,954 | S | 9/2010 | Hawry | | |
| D653,548 | S | 2/2012 | Wycoff | | |
| D691,052 | S | 10/2013 | Minghetti | | |
| D751,913 | S | 3/2016 | Seecof | | |
| 9,290,310 | B2 | 3/2016 | Sinn | | |
| 2003/0173364 | A1 * | 9/2003 | Eva | B65D 25/2894 | 220/524 |
| 2004/0011812 | A1 | 1/2004 | Kasting | | |
| 2006/0076260 | A1 | 4/2006 | Luburic | | |
| 2007/0045213 | A1 | 3/2007 | Voss et al. | | |
| 2007/0187413 | A1 | 8/2007 | Gruskin | | |
| 2008/0277418 | A1 * | 11/2008 | Vockler | B44D 3/12 | 222/111 |

* cited by examiner

STORAGE CONTAINER WITH SPOUT

CROSS-REFERENCE TO RELATED APPLICATIONS

This U.S. patent application claims priority to and the benefit of U.S. Provisional Patent Application Ser. No. 62/311,078 filed on Mar. 21, 2016; U.S. Provisional Patent Application Ser. No. 62/313,282 filed on Mar. 25, 2016; U.S. Provisional Patent Application Ser. No. 62/356,812 filed on Jun. 30, 2016; and U.S. Provisional Patent Application Ser. No. 62/373,032 filed on Aug. 10, 2016. The entireties of the aforementioned applications are herein incorporated by reference.

TECHNICAL FIELD

Embodiments of the subject matter disclosed herein relate to a storage container with a spout, and more particularly a storage container with for a coating material.

DISCUSSION OF ART

The most common way to store coating materials (e.g., paints, stains, varnishes, chemicals, etc.) is a metal can having a metal removable lid, wherein the can has a circular shape. In use, a prying tool is used to remove the lid and the paint is stirred and dispensed from the can. Alternatively, a brush can be dipped directly into the can and the brush is used to apply the coating material to an object. Most metal cans, such as steel paint cans, are moved and carried using a bail made from a steel wire and mounted on opposite sides of the container.

Conventional paint cans have numerous drawbacks. First, removal of the lid can be difficult because a prying tool is required. A lid removal tool is fairly efficient, but often a screwdriver is used instead making the task more difficult. Replacement of the lid is also difficult in that a hammer or mallet is required to completely reseat opposed mating grooves on the lid and container. More often than not, individuals step on the top of the can to press the lid into place. This can be hazardous by possibly causing physical injury, damage to the metal paint can, or spillage of the coating material stored in the metal paint can.

It may be desirable to have an improved storage container for coating materials.

BRIEF DESCRIPTION

In an embodiment, a storage container with a spout is provided that can store a coating material. The storage container can include a container body having a shape, which may be a circular shape, polygonal shape, or a rounded-polygonal shape. The container body includes a side wall having first and second ends. The storage container with a spout can include a first opening with a corresponding lid and the spout providing a second opening with a corresponding cap. The storage container can further include a handle formed with an aperture through a side of the container body.

BRIEF DESCRIPTION OF THE DRAWINGS

Reference is made to the accompanying drawings in which particular embodiments and further benefits of the provided subject matter are illustrated as described in more detail in the description below.

DETAILED DESCRIPTION

Figure 1:
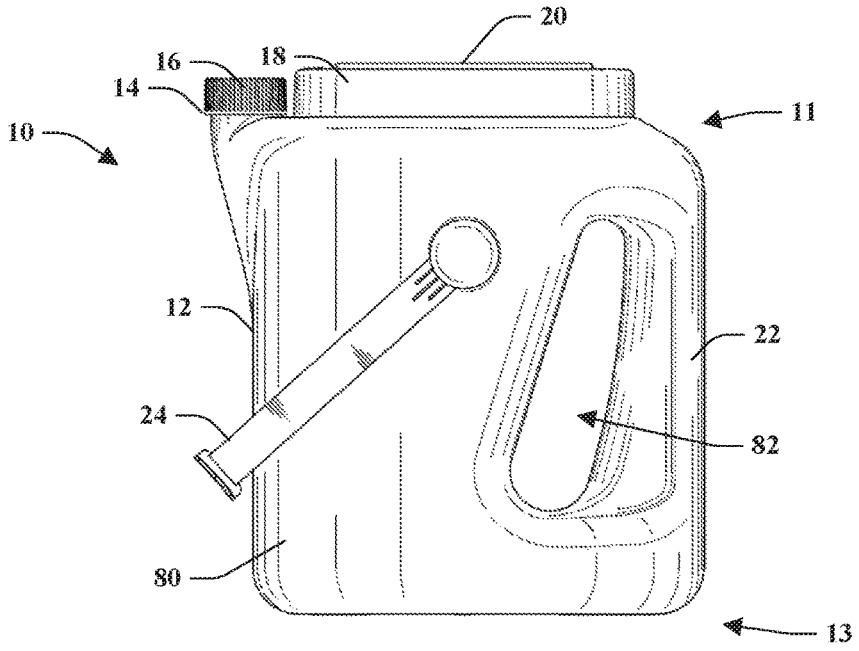
FIG. 1 illustrates a storage container with a spout and a handle.
Figure 2:
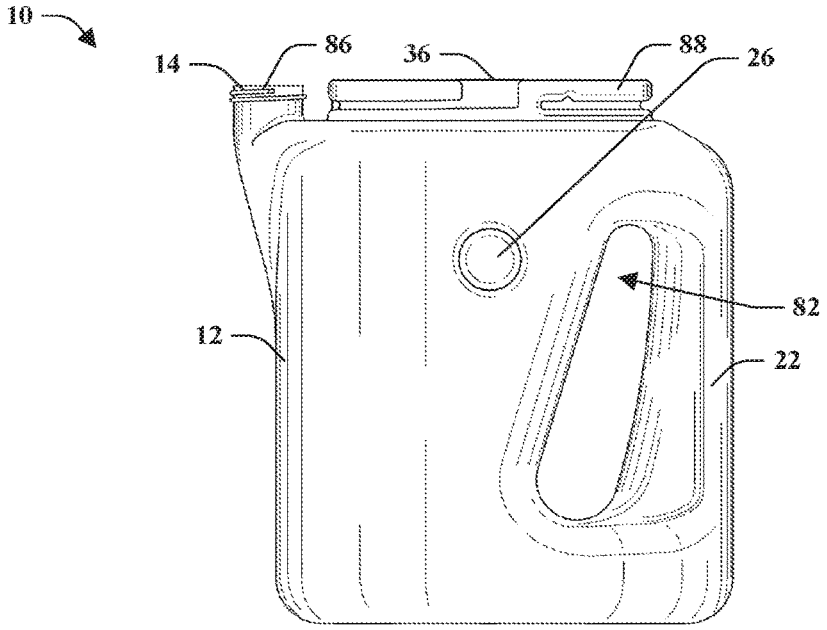
FIG. 2 illustrates a storage container with a spout.
Figure 3:
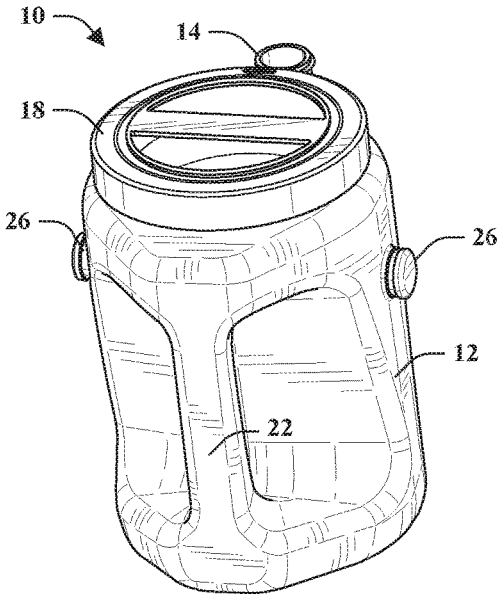
FIG. 3 is a perspective view of the storage container.
Figure 4:
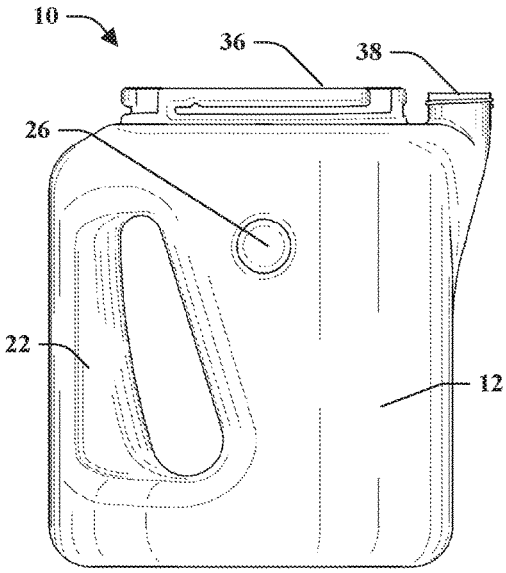
FIG. 4 is a left side view of the storage container with the right side view of the storage container being a mirror image thereof.
Figure 5:
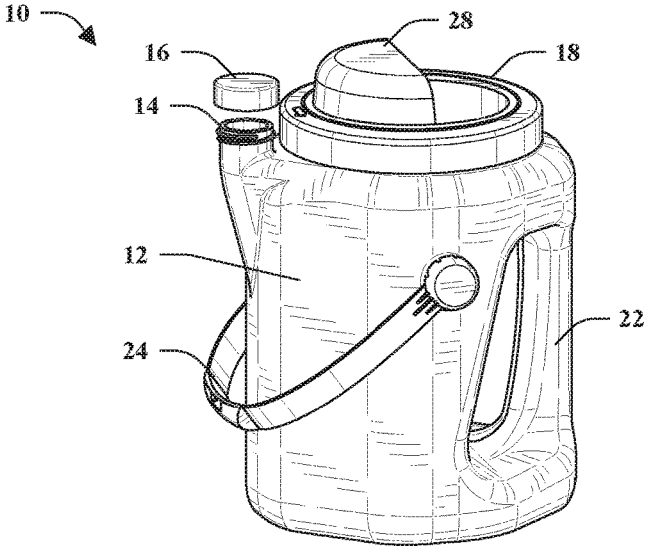
FIG. 5 illustrates a storage container with a spout and a handle.

Embodiments of the provided subject matter relates to a storage container. The storage container is provided for storing a coating material or storing a volume. The storage container includes a container body having a shape. The storage container can include a first opening accessible via a lid and a spout providing a second opening accessible via a cap. The storage container can include a build-in handle and/or a bail-type handle to facilitate carrying the storage container.

The subject application includes features of utility and ornamental design for a storage container as described herein.

Turning now to FIGS. 1-13, a storage container 10 is illustrated. The storage container 10 is provided for storing a coating material or storing a volume. The storage container 10 includes a container body 12 having a shape, in which the shape from a top view can be, but is not limited to, circular, polygonal, square, rectangle, triangle, hexagonal, prolate spheroid (e.g., football-shaped), eye-shaped, among others. The container body 12 includes a first end 11 and a second end 13 opposite the first end 11 and separated by a height or distance, wherein the first end 11 can include a first opening 36 and a second opening 38 (the second opening also referred to as a spout 14). The body 12 can include a sidewall 80 that connects the first end 11 with the second end 13. The sidewall 80 can connect to the first end 11 and the second end 13 with a shoulder or a rounded or beveled edge. The first opening 36 can be accessible with a removable lid 18 and the second opening 38 can be accessible with a cap 16. The removable lid 18 can include a built-in handle 20 that is created from a recess into the removable lid 18 on a top side thereof. It is to be appreciated that the built-in handle 20 can be curved or ergonomically designed to increase comfort when mating with the palm or fingers of a hand when grabbing holding the built-in handle 20.

The lid 18 can be removable to the storage container 10 with a first threading on the inside of the lid 18 that mates with a second threading included on a collar of the first end 11 of the storage container, wherein the collar forms the first opening 36. Additionally, the cap 16 of the spout 14 can be removable to the storage container 10 by utilizing a threading on the inside of the cap 16 which mates with a threading on a rim of the spout 14. It is to be appreciated that the volume or material stored in the storage container 10 can be accessible by the first opening 36, the second opening 38, or a combination thereof. In a particular embodiment, the first opening 36 and the second opening 38 are circular in shape, yet it is to be appreciated that the first opening 36 and the second opening 38 can have various sizes or shapes respectively as well as corresponding caps or lids. In addition, the first opening 36 can be larger than the second opening 38 but each can be any suitable size or shape. For example, the first opening 36 can be the same size as the second opening 38 or the second opening 38 can be larger than the first opening 36.

Figure 6:
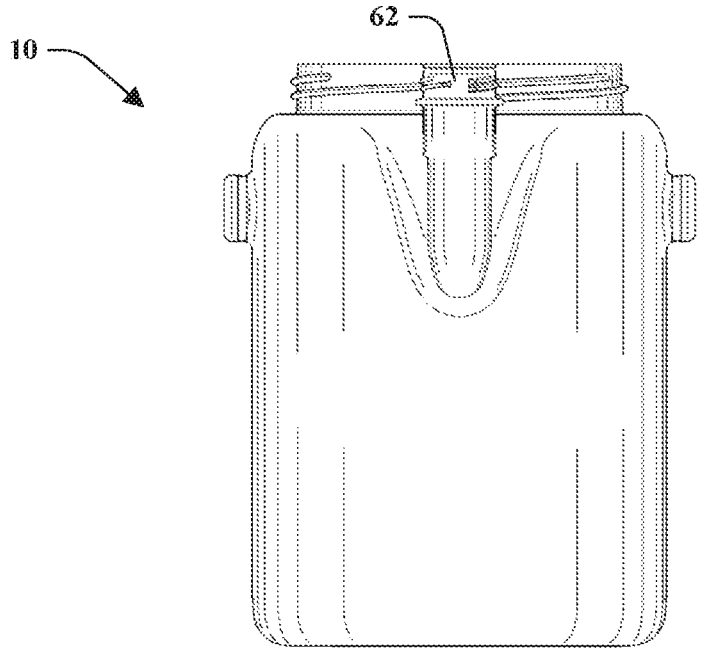
FIG. 6 illustrates an embodiment of a storage container.
Figure 7:
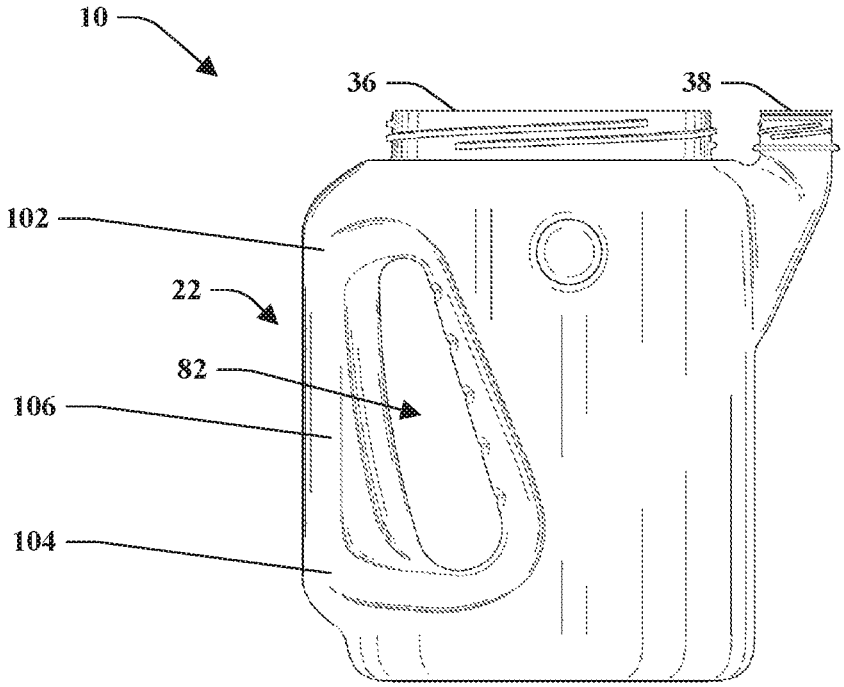
FIG. 7 illustrates an embodiment of a storage container.
Figure 8:
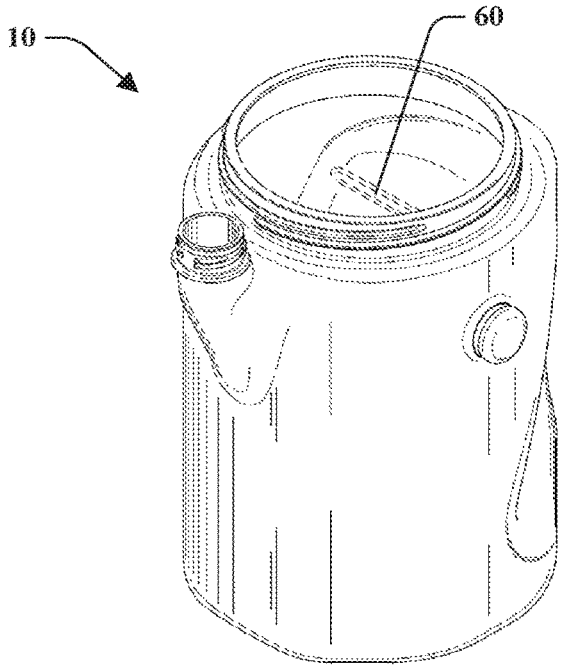
FIG. 8 illustrates an embodiment of a storage container.
Figure 9:
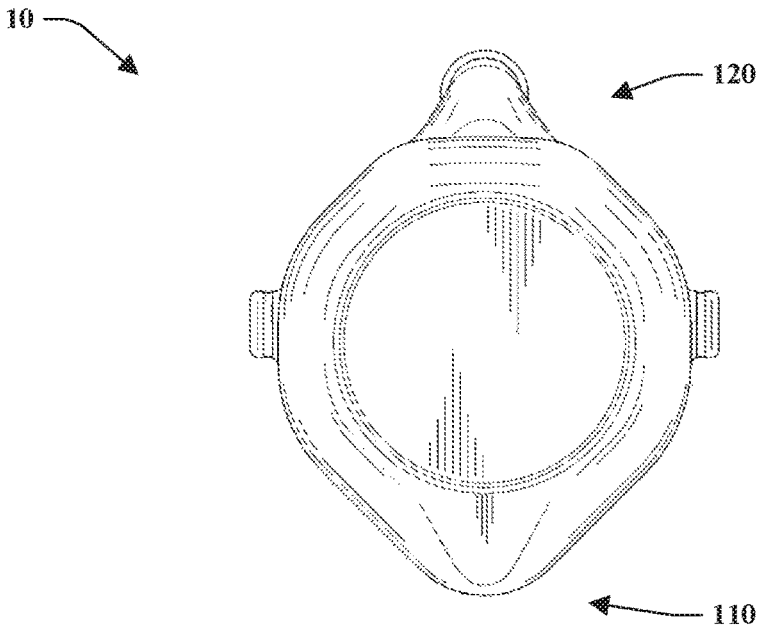
FIG. 9 illustrates an embodiment of a storage container.
Figure 10:
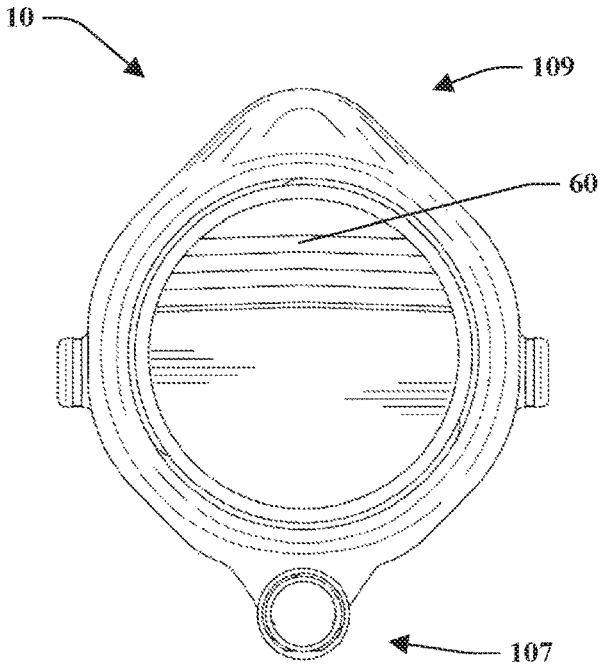
FIG. 10 illustrates an embodiment of a storage container.
Figure 11:
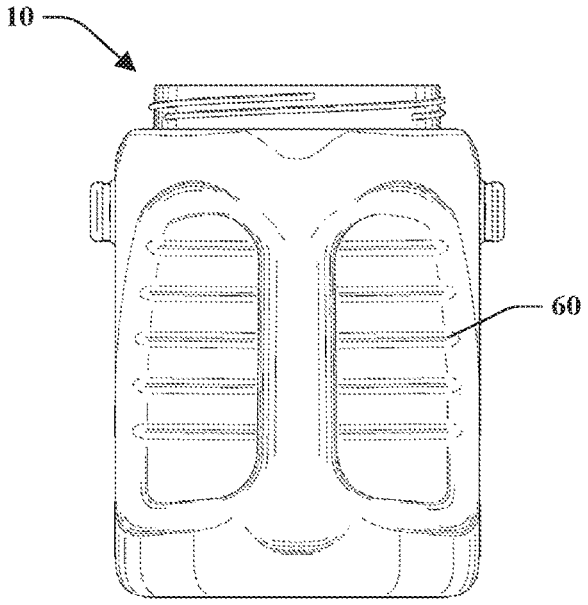
FIG. 11 illustrates an embodiment of a storage container.
Figure 12:
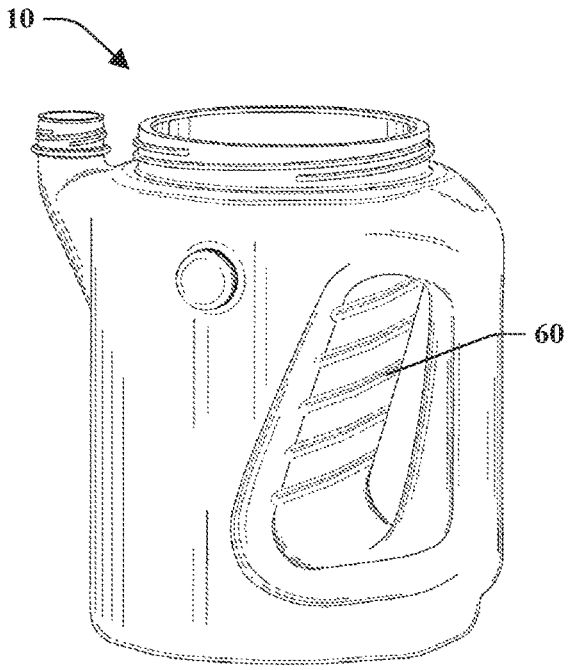
FIG. 12 illustrates an embodiment of a storage container.
Figure 13:
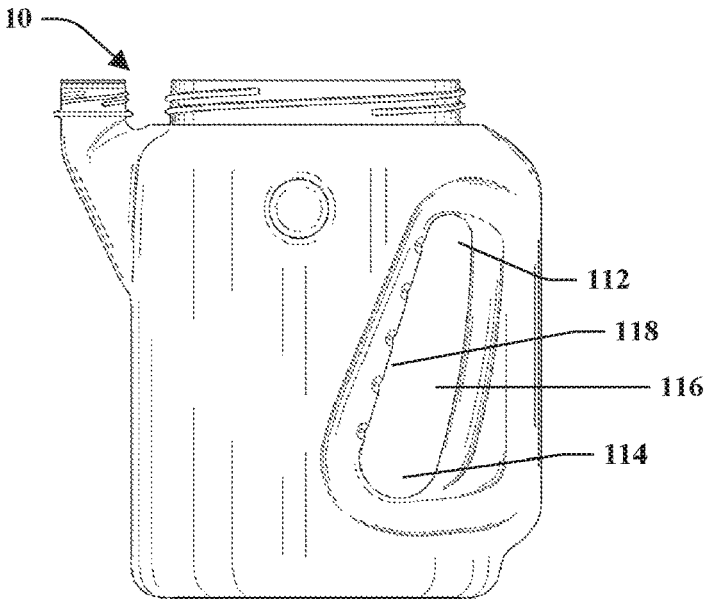
FIG. 13 illustrates an embodiment of a storage container.
Figure 14:
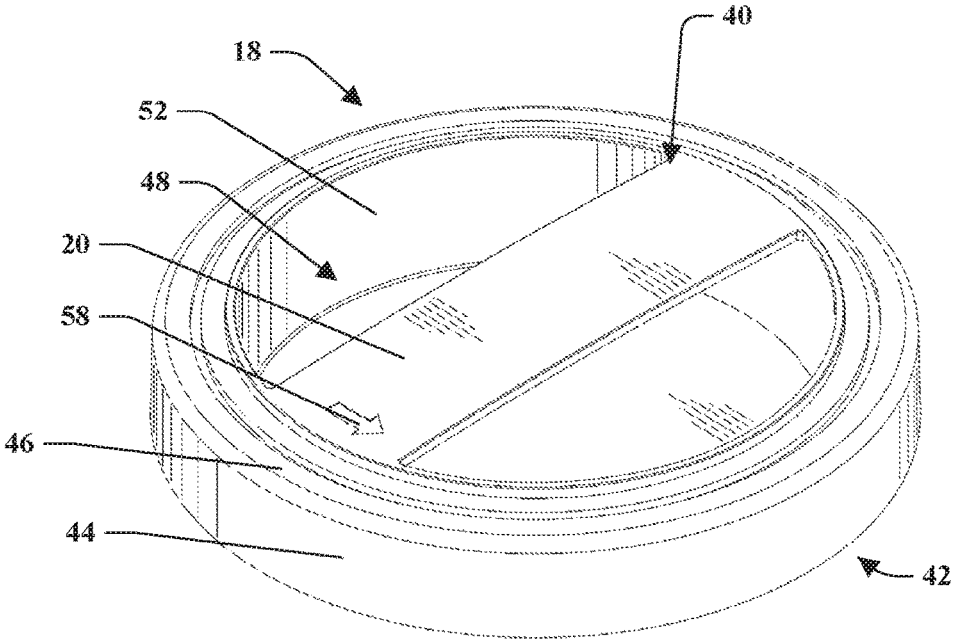
FIG. 14 illustrates an embodiment of a lid.

FIG. 6 illustrates a front side of the container 10. FIG. 7 illustrates a left side of the container 10. FIG. 8 is a perspective view of the container 10 from a front angle. FIG. 9 is a bottom view of the container 10 which is also the second end 13. FIG. 10 illustrates a top view of the container 10 which is also the first end 11. FIG. 11 is a back side of the container 10 which is opposite the front side of the container 10. FIG. 12 is a perspective view of the container 10 from a rear angle. FIG. 13 is a right side of the container 10 that is opposite of the right side of the container 10.

The storage container 10 can further include an integrated handle 22 that is formed with aperture 82 through the container body 12 on a location (e.g., side, front, rear, etc.) between the first end 11 and the second end 13. The aperture 82 separates the integrated handle 22 from the body 12. In an embodiment, the integrated handle 22, the first opening 36, and the second opening 38 are aligned to one another. The second opening 38 and the integrated handle can be aligned but on opposite sides of one another on the body 12. In particular, the second opening 38 can be located on the first end 11 on a front side of the body 12 which is opposite the integrated handle 22 that is located on a backside opposite the front side of the body 12. In other words, the second opening 38, the integrated handle 22, and the first opening 36 can be aligned to one another such that a center of the first opening 36, a center of the second opening 38, and a center of the integrated handle lie in the same geometric plane.

In an embodiment, the aperture 82 is orthogonal to the geometric plane in which the center of the first opening 36, the center of the second opening 38, and the center of the integrated handle 22 lie. The aperture 82 includes a top 112, a bottom 114 opposite the top 112, a handle side 116, and a body side 118. The top 112 of the aperture 82 is proximate to the first end 11 and the bottom of the aperture 82 is proximate to the second end 13. It is to be appreciated that the aperture 82 can be a shape that allows for receipt of a hand, fingers, or a portion thereof to facilitate holding the storage container 10.

The aperture 82 can be a shape such as, but not limited to, rounded-rectangle, a square, a rectangle, a pill-shape, a circular shape, a rounded polygon, a rounded rectangle, cucumber-shaped, eggplant-shaped, among others. For example, the shape of the aperture 82 can be a rounded pill-shape in which each end has a diameter. The top of the aperture 82 can have a portion of a first diameter and the bottom having a portion of a second diameter, wherein the first diameter is less than the second diameter. In such rounded pill-shape for the aperture 82, the distance between the body side and the handle side can be uniform, increasing from top to bottom, or decreasing from top to bottom.

The integrated handle 22 lies within a cross-section of the container 10 as defined by the sidewalls 80. In other words, the integrated handle 22 does not extend beyond the sidewalls of the container 10. The integrated handle 22 is formed by the aperture 82 and includes a handle top 102, a handle bottom 104, grip section 106 in between the handle top 102 and the handle bottom 104. The grip section 106 can be a shape such as, but not limited to, circular, rounded, rectangular with rounded edges, oval, among others. The grip section 106 is generally rounded in shape and can include a uniform or varying diameter from the handle top 102 to the handle bottom 104. In particular, the diameter of the grip section 106 can be an increasing diameter from the handle top 102 to the handle bottom 104. In another embodiment, the grip section 106 can include a decreasing diameter from the handle top 102 to the handle bottom 104. The handle top 102 connects with the first end 11 and the handle bottom 104 connects with the second end 13. The aperture 82 separates the grip section 106 from the body 12, and in particular, the grip section 106 from the body side of aperture 82.

The handle top 102 can include a first curved portion and a second curved portion opposite thereof for the connection to the first end 11. The curved portions create the handle top 102 of the integrated handle 22. Similarly, the handle bottom 104 can include a first curved portion and a second curved portion opposite thereof for the connection to the second end 13. The curved portions create the handle bottom 104 of the integrated handle 22. For example, the curved portions for the handle top 102 and the handle bottom 104 can be parabolic shaped.

In another embodiment, the shape can be configured to receive four fingers. It is to be appreciated that the integrated handle 22 can be any suitable size such that the integrated handle 22 is integrated into the container body 12. Moreover, the integrated handle 22 can be configured to hold the volume of the storage container 10 or be solid and not hold volume of the storage container or a combination thereof.

Continuing with FIGS. 1-13, the container 10 is shown having a generally prolate spheroid shape. The top view of the container 10 is illustrated in FIG. 10 which is also showing the first end 11. The below describes the shape of the container from a top view. The front side on the first end 11 includes the second opening 38 that extends from the body 12 providing a shape of a front curve 107. The back side of the first end 11 includes the integrated handle 22 and provides a shape of a back curve 109 opposite the front curve 107. The left side of the first end 11 is generally rounded in shape and connects between a portion of the back curve 109 to a portion of the front curve 107. The right side of the first end 11 is opposite the left side and is generally rounded in shape to connect between a portion of the back curve 109 to a portion of the front curve 107. It is to be appreciated that the left side and the right side can be mirror-images of one another. It is to be appreciated that the front curve 107 and the back curve 109 can be similar in shape but vary in size due to the shape of the second opening 38 being different than the integrated handle 22.

The bottom view of the container 10 is illustrated in FIG. 9 which is also showing the second end 13. The below describes the shape of the container from a bottom view. The front side on the second end 13 includes a flat shape 120. The back side on the second end 13 includes the integrated handle 22 and provides a shape of a back curve 110 opposite the flat shape 120. The left side on the second end 13 is generally rounded in shape and connects between a portion of the back curve 110 to a portion of the flat shape 120. The right side on the second end 13 is opposite the left side and is generally rounded in shape to connect between a portion of the back curve 110 to a portion of the flat shape 120. It is to be appreciated that the left side and the right side can be mirror-images of one another.

The second opening 38 can include a neck portion that couples to a transition portion that extends from the body 12 proximate to the first end 11. The neck portion can be a circular shape and the transition section 84 can be generally a pyramid shape in which a top of the pyramid is positioned toward the second end 13 and the base of the pyramid is positioned toward the first end 11. The neck portion can couple to a corner of the base of the pyramid that is extended from the sidewall of the body 12.

Figure 38:
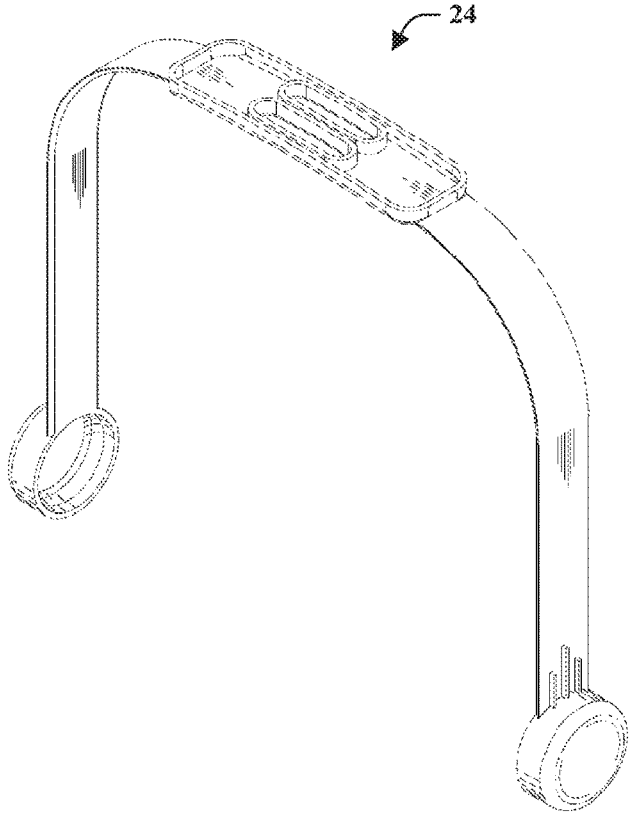
FIG. 38 illustrates an embodiment of a pail-type handle.
Figure 39:
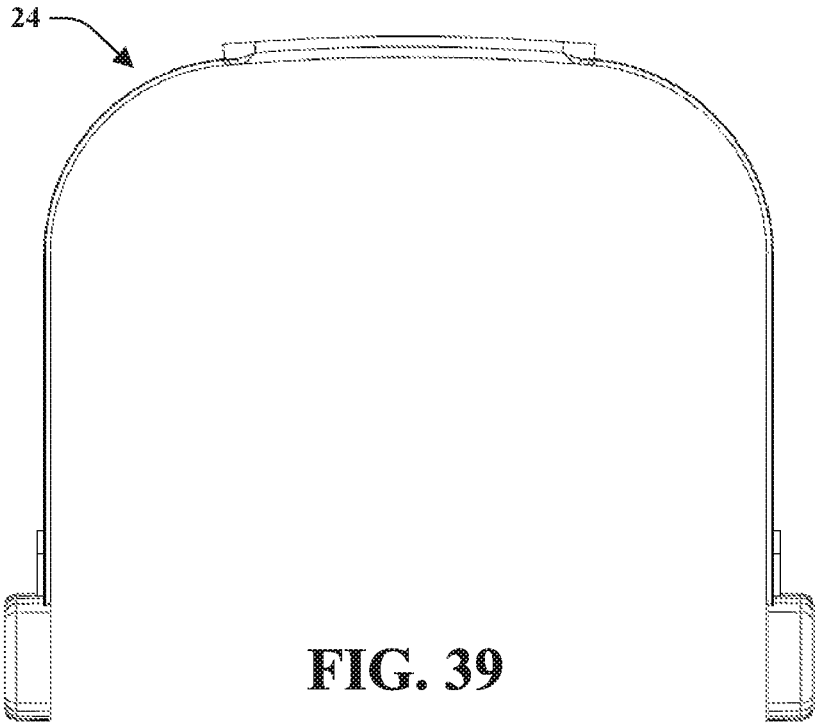
FIG. 39 illustrates an embodiment of a pail-type handle.
Figure 40:
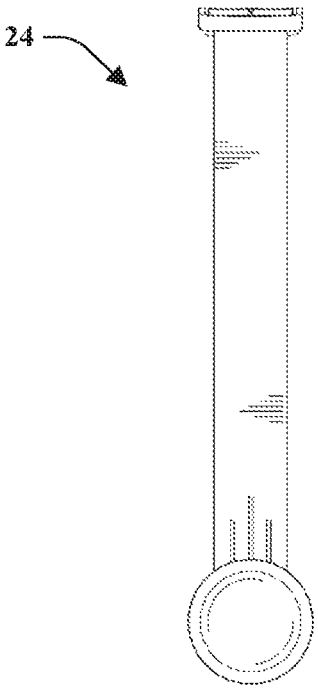
FIG. 40 illustrates an embodiment of a pail-type handle.
Figure 41:
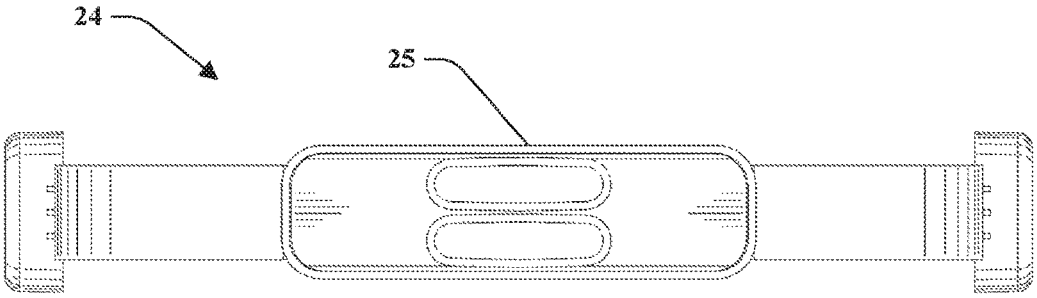
FIG. 41 illustrates an embodiment of a pail-type handle.
Figure 42:
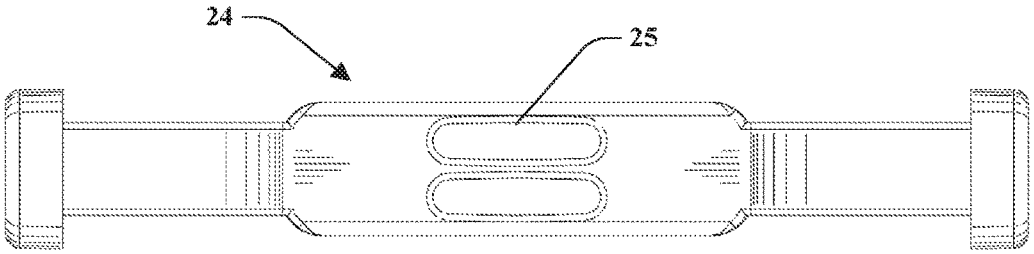
FIG. 42 illustrates an embodiment of a pail-type handle.
Figure 43:
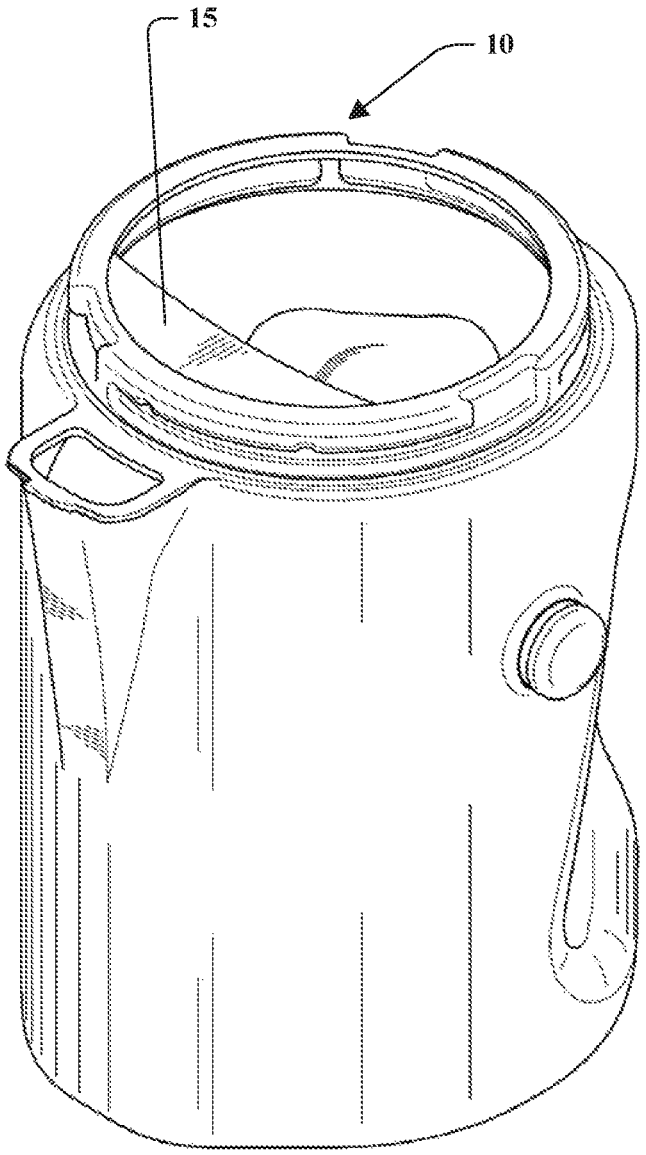
FIG. 43 illustrates an embodiment of a storage container.
Figure 44:
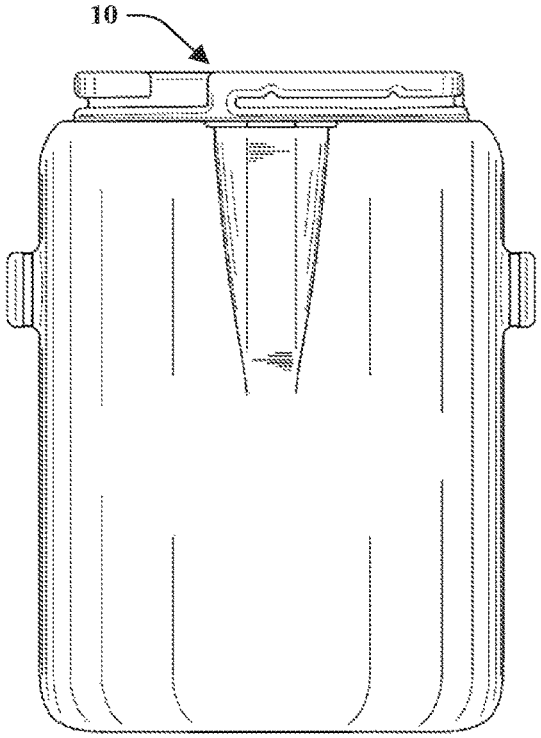
FIG. 44 illustrates an embodiment of a storage container.
Figure 45:
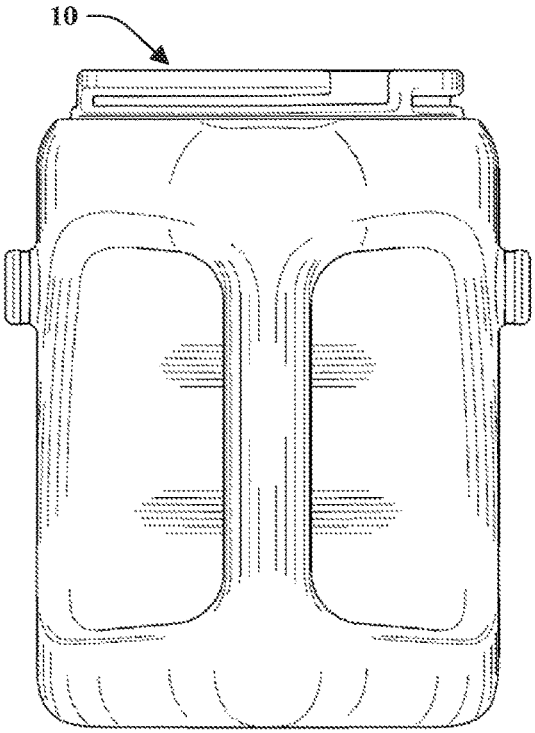
FIG. 45 illustrates an embodiment of a storage container.
Figure 46:
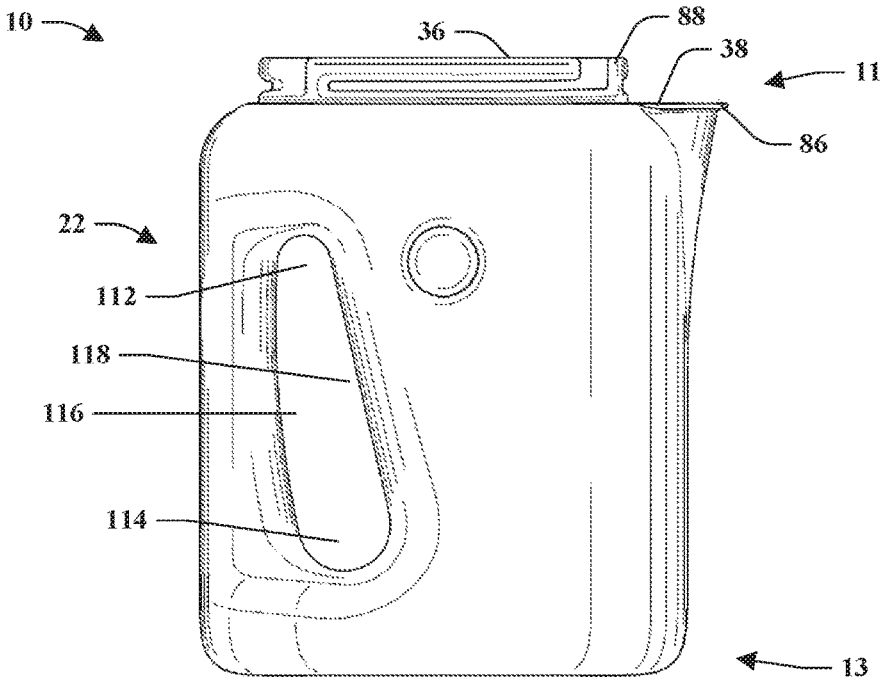
FIG. 46 illustrates an embodiment of a storage container.
Figure 47:
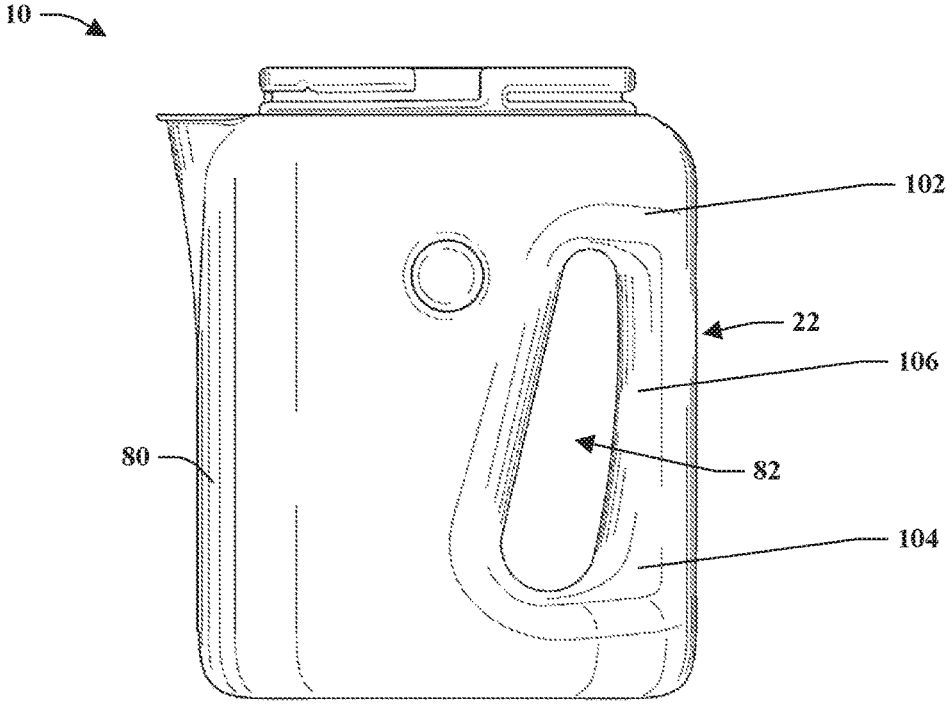
FIG. 47 illustrates an embodiment of a storage container.

The container 10 can include one or more nodules 26 (also referred to as ears), wherein the nodules 26 are configured to couple to a pail-type handle 24 to facilitate carrying or lifting the container 10. For instance, the storage container 10 can further include the bail-type handle 24 that can be coupled to the container body 12. In a particular embodiment, the bail-type handle 24 can be coupled to one or more nodules 26. Moreover, the bail-type handle 24 can be removably attached in an embodiment. A first nodule can be positioned on a left side of the container 10 and a second nodule can be positioned on a right side of the container 10, wherein the first nodule couples to a first end of the pail-type handle 24 and the second nodule couples to a second end of the pail-type handle 24. The pail-type handle 24 can include a connector 25 (seen in at least FIGS. 36 through 39) that can be used to attach to a ladder or other stepping device and/or connect to a bail hook. The pail-type handle 24 is illustrated in a perspective view (FIG. 38), a front view (FIG. 39), a right side view (FIG. 40) of which a left side is a mirror-image, a bottom view (FIG. 41), and a top view (FIG. 42). In another embodiment, the one or more nodules 26 can be used to removably couple an attachment to the storage container 10. For example, the attachment can be the bail-type handle 24, a tray, a tool holder, an applicator of the material, a brush, among others.

The storage container 10 can include a recess on the bottom portion of the storage container that is shaped and sized to receive or mate with the lid 18 and the spout 14 and cap 16.

Turning to FIGS. 6-13, the container 10 is illustrated and includes one or more ridges or ribs 60 on an interior surface of the body side of the aperture 82 located on the back side of the container 10. The one or more ridges or ribs 60 can be used to receive a roller or other applicator device (e.g., paint brush, roller, stain brush, among others), wherein the rib or ridges 60 facilitate application or removal of the material stored in the storage container 10 to be applied to a roller or other applicator device. The ridges 60 can be spaced apart a distance and situated internally on a substantially flat surface that is angled from the back side toward the front side. The ridges 60 can be orientated parallel to one another and in a first end 11 to second end 13 direction. In another embodiment, the ridges 60 can be orientated parallel to one another and in a left side to right side direction. In still another embodiment, the ridges 60 can include a pattern such as, but not limited to, a cross-hatch pattern, a diagonal pattern, circle pattern, dimple pattern, teeth pattern, zig-zag pattern, among others. The storage container 10 can further include a vent or breathing hole located on the container body 12, the first end 11 to facilitate pouring of stored material from the storage container 10 by eliminating or reducing any vacuum. It is to be appreciated that the vent or breathing hole can include a cover or cap.

The spout 14 or second opening 38 can include threads on a rim or lip 86 to allow removable attachment of a cap 16. In an embodiment, the spout 14 or second opening 38 can include an area 62 that does not include a thread(s) so as to be a smooth surface. In other words, the second opening 38 can include a range of degrees or area 62 that do not include a thread or threads so as to reduce material from the storage container 10 collecting on such lip 86 or rim of the second opening 38. With the range of degrees or area 62 on the spout 14 that do not include a thread or threads, the smooth surface is easier to keep clean or remove/clean material therefrom. This reduces the material causing the cap 16 to be unnecessarily stuck or sticky to the spout 14 due to build-up of material housed in the storage container 10.

FIGS. 14-20 illustrate an embodiment of the lid 18. Lid 18 can include a top side 40, a bottom side 42, and a side wall 44 extending around a circumference of the lid 18. The top side 40 can include a built-in handle 20 and an annular rim 46. The annular rim 46 can be a ring-shaped horizontal surface connected at its outer circumference to the top of side wall 44, extending radially inwards, with its inner circumference terminating at the top of a recessed area side wall 52. In some embodiments, the annular rim 46 has a groove formed in its surface. The built-in handle 20 can be slightly raised above the annular rim 46, flush with the annular rim 46, or below the annular rim 46. The built-in handle 20 spans over the recessed area 48, across a diameter of the top side 40 and can be connected on either end of the top side 40 at opposing sides of the annular rim 46. The built-in handle 20 can be straight or curved. In certain embodiments, finger ridges are included in the bottom face of the built-in handle 20 to allow a user's fingers to grip the built-in handle 20. The built-in handle 20 can be oriented at any angle across the top side 40 of lid 18. In certain embodiments, the built-in handle 20 is in-line with the axis connecting the center of the integrated handle 22 and the second opening 38 when the lid 18 is in its closed position. In other embodiments, the built-in handle 20 is at a different angle (for example, 90°) from the axis connecting the center of the integrated handle 22 and the second opening 38 when the lid 18 is in its closed position.

The recessed area 48 is formed under the built-in handle 20 and within the circular interior wall of the annular rim 46. The recessed area 48 can include a floor 50 and the recessed area side wall 52 formed by the inner circumference of the annular rim 46. This recessed area 48 can allow a user's hand to fit beneath the built-in handle 20 in order to grip the built-in handle 20 to carry the lid 18 or the container 10 attached to the lid 18, or to twist the lid 18 on or off the collar 88 of the first opening 36.

The top side 40 of lid 18 can also include one or more visual indicators. For example, the top side 40 can include an arrow 58 indicating a twisting direction to unscrew the lid 18 from the collar 88 of the first opening 36. The arrow 58 can alternatively indicate a twisting direction to screw the lid 18 onto the collar 88. In certain embodiments, the top side 40 includes two arrows 58, with one arrow 58 indicating a twisting direction to unscrew the lid 18 and one arrow 58 indicating a twisting direction to screw on the lid 18. In other embodiments, the one or more visual indicators can include an arrow corresponding with another mark or indicator on the container 10. For example, when the arrow is aligned with a first mark on the container 10, this indicates that the lid 18 is in a closed position. When the arrow is aligned with a second mark on the container 10, this indicates that the lid 18 is in an open position.

Figure 15:
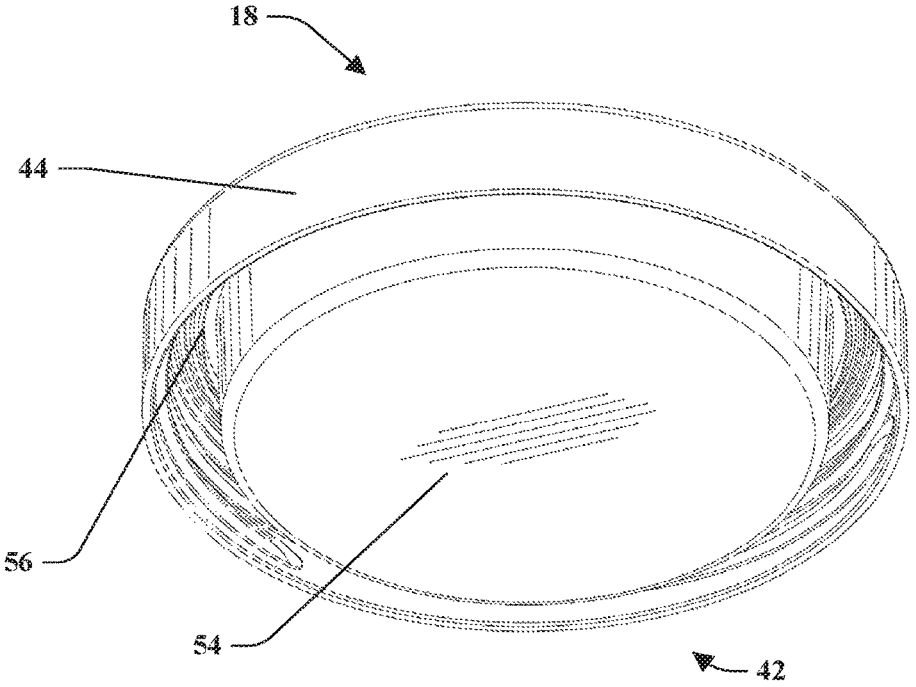
FIG. 15 illustrates an embodiment of a lid.
Figure 16:
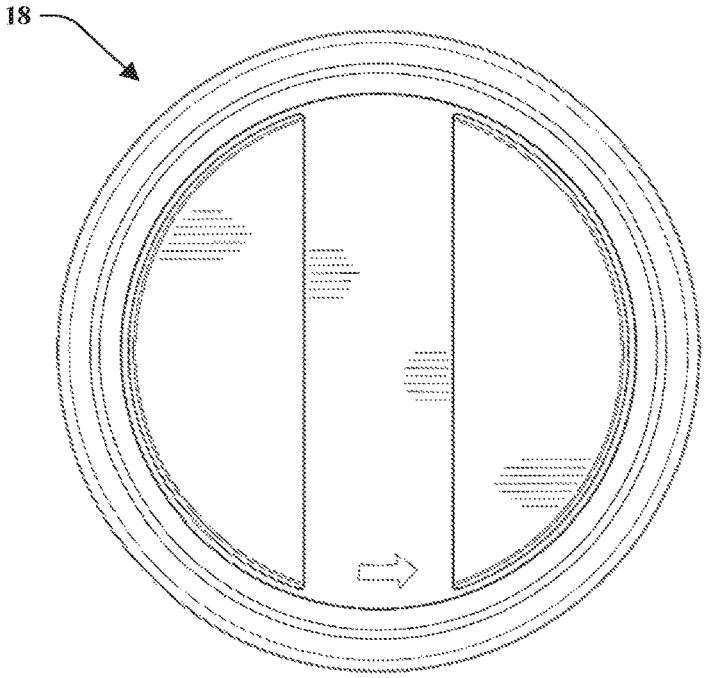
FIG. 16 illustrates an embodiment of a lid.
Figure 17:
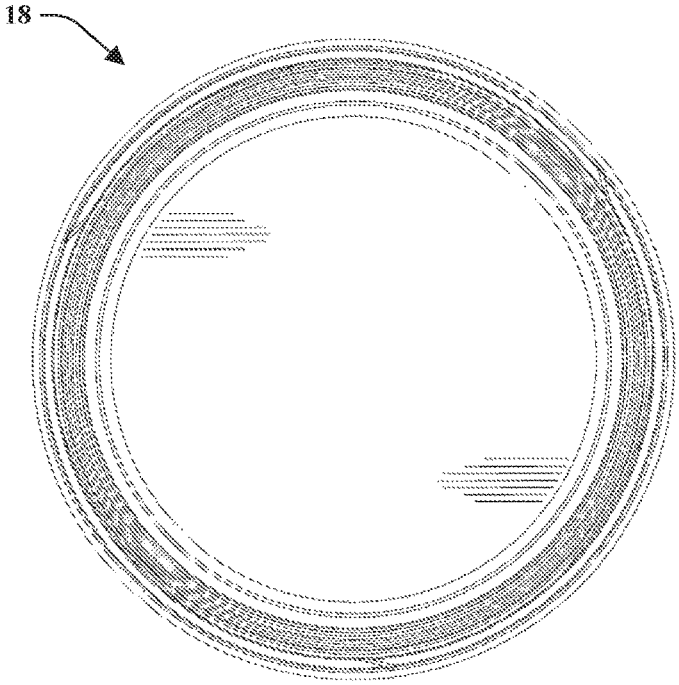
FIG. 17 illustrates an embodiment of a lid.
Figure 18:
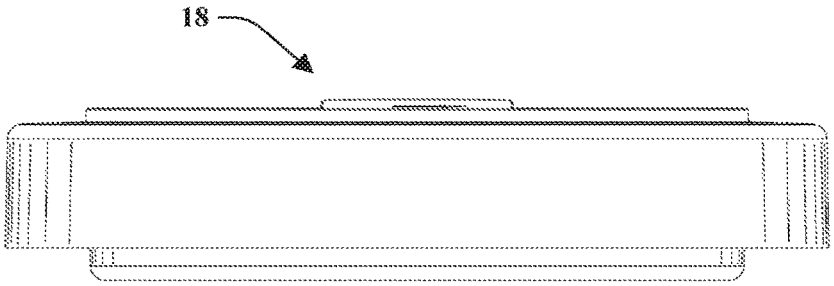
FIG. 18 illustrates an embodiment of a lid.
Figure 19:
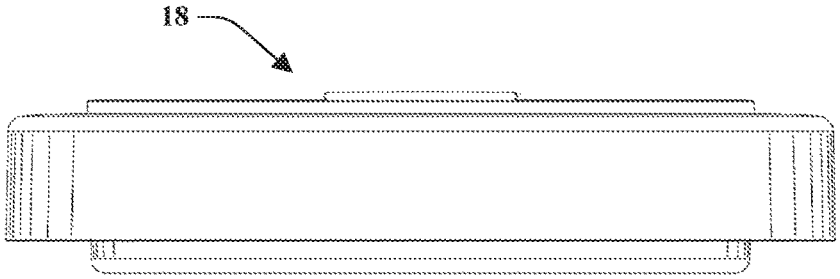
FIG. 19 illustrates an embodiment of a lid.
Figure 20:
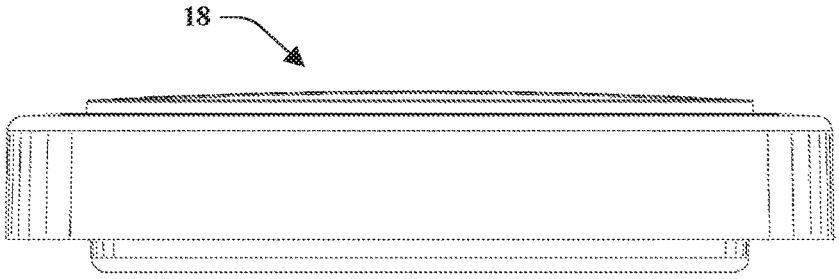
FIG. 20 illustrates an embodiment of a lid.
Figure 21:
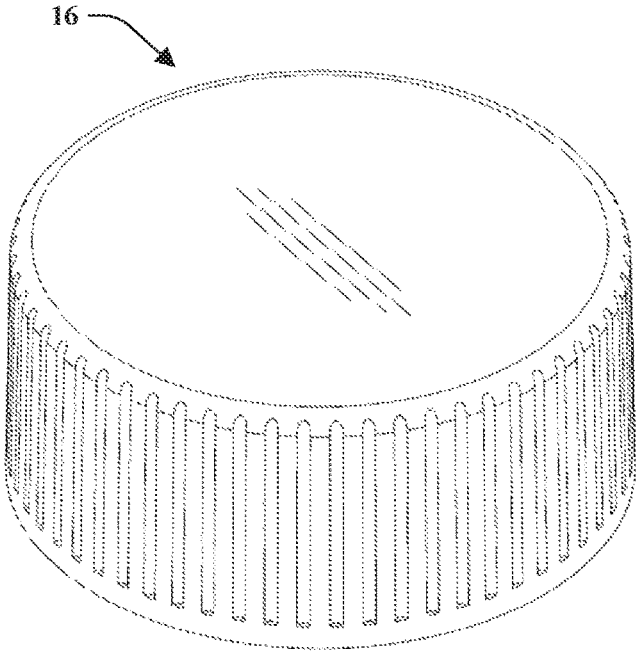
FIG. 21 illustrates an embodiment of a cap.
Figure 22:
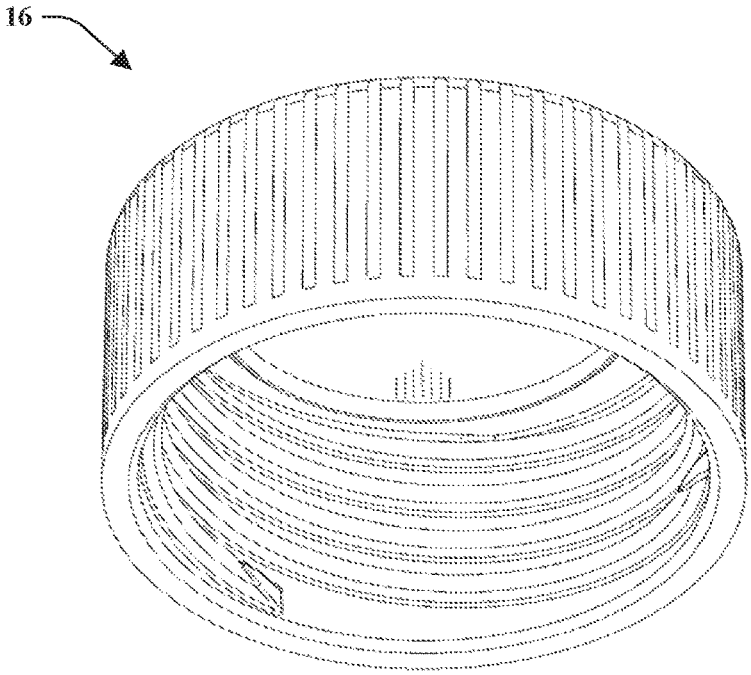
FIG. 22 illustrates an embodiment of a cap.
Figure 23:
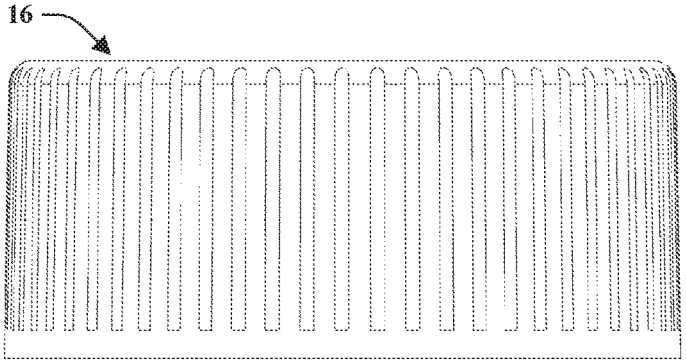
FIG. 23 illustrates an embodiment of a cap.
Figure 24:
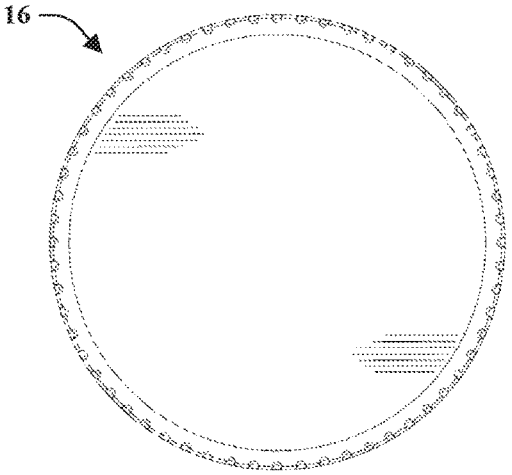
FIG. 24 illustrates an embodiment of a cap.
Figure 25:
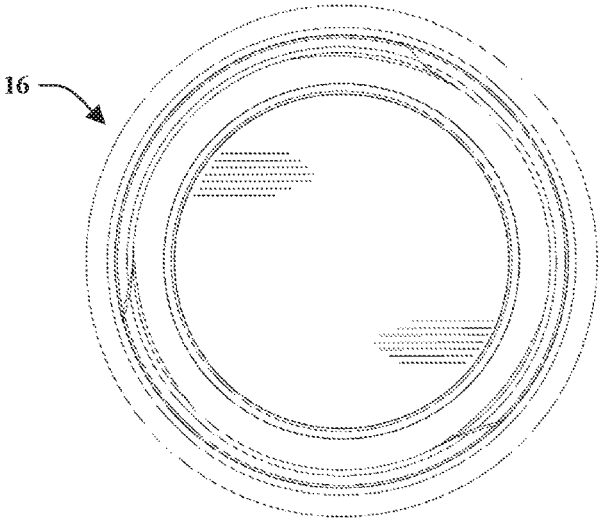
FIG. 25 illustrates an embodiment of a cap.
Figure 26:
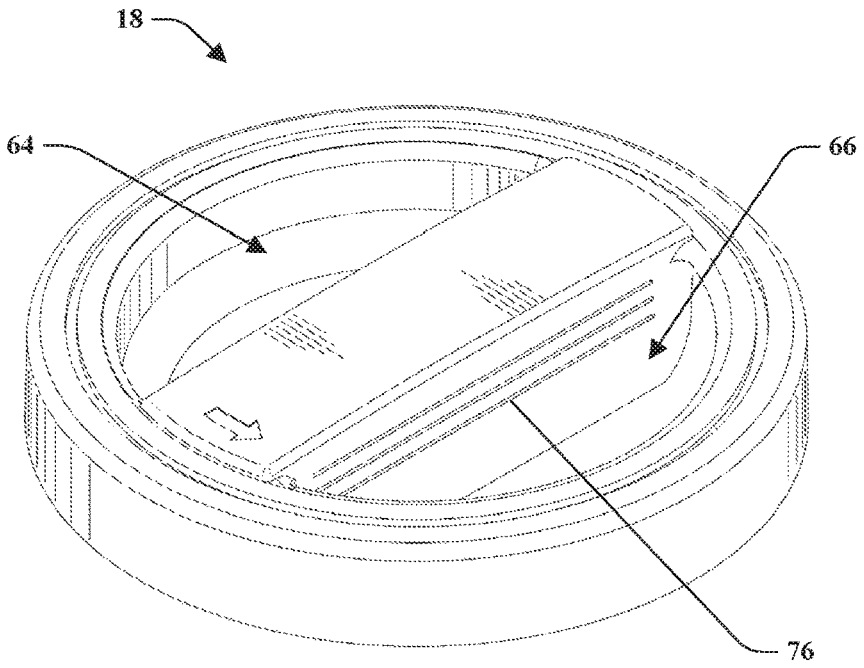
FIG. 26 illustrates an embodiment of a lid.
Figure 27:
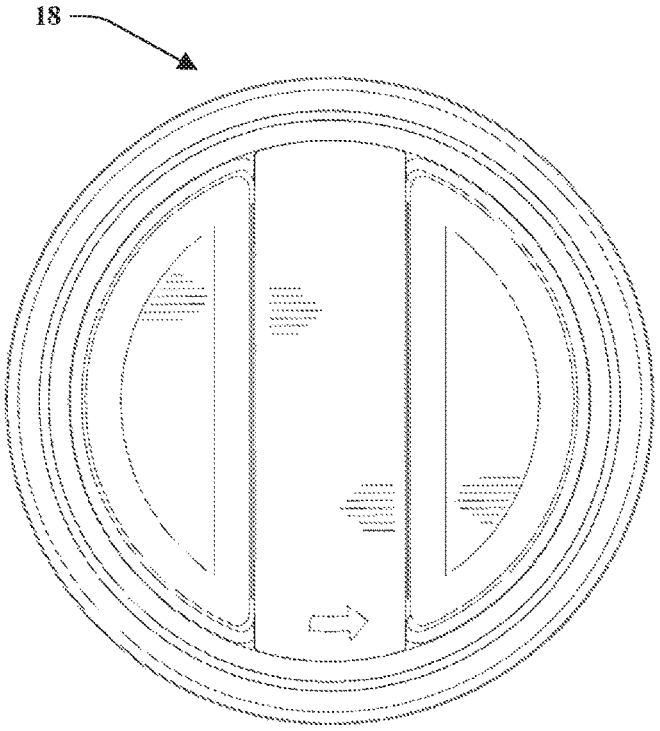
FIG. 27 illustrates an embodiment of a lid.
Figure 28:
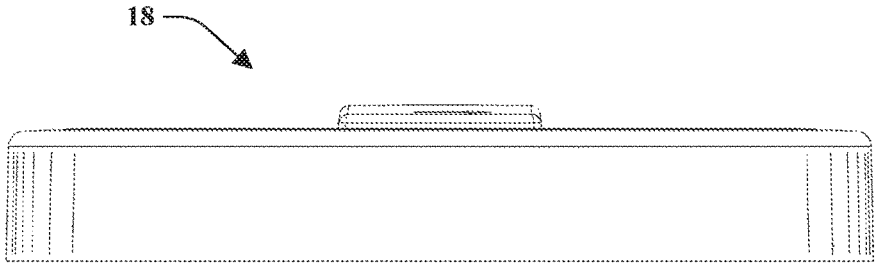
FIG. 28 illustrates an embodiment of a lid.
Figure 29:
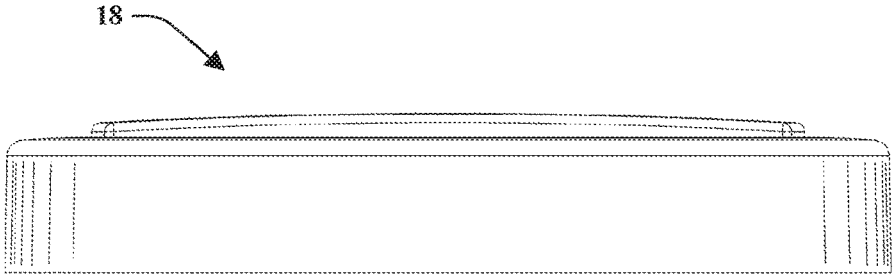
FIG. 29 illustrates an embodiment of a lid.

As seen in FIG. 15, the inside of the side wall 44 can include one or more threads. These one or more threads can mate with a second threading included on a collar 88 of the first opening 36 of the storage container 10. The bottom side 42 of lid 18 can include a bottom surface 54 and an annular groove 56 formed between the bottom surface 54 and the inside surface of the side wall 44. The bottom surface 54 is formed by the depression created by the recessed area 48. As can be seen in FIGS. 18-20, the bottom surface 54 can extend below the bottom of the side wall 44. In other embodiments, the bottom surface 54 can be on the same horizontal plane as the bottom of the side wall 44 or it can be above the bottom of the sidewall 44. The annular groove 56 is sized appropriately to mate or engage with the collar 88 of the first opening 36. In other words, the shape and size of the annular groove 56 corresponds to the shape and size of collar 88. This mating or engagement allows the one or more threads of the lid 18 to be threadingly engaged with the second threading included on the collar 88.

Turning now to FIGS. 26-30, an embodiment of the lid 18 includes built-in handle wall sides 76. The built-in handle wall sides 76 stand vertically and extend along the length of each side of the built-in handle 20. The built-in handle wall sides 76 divide the recessed area 48 into two recessed areas (64, 66) on either side of the built-in handle 20.

Figure 30:
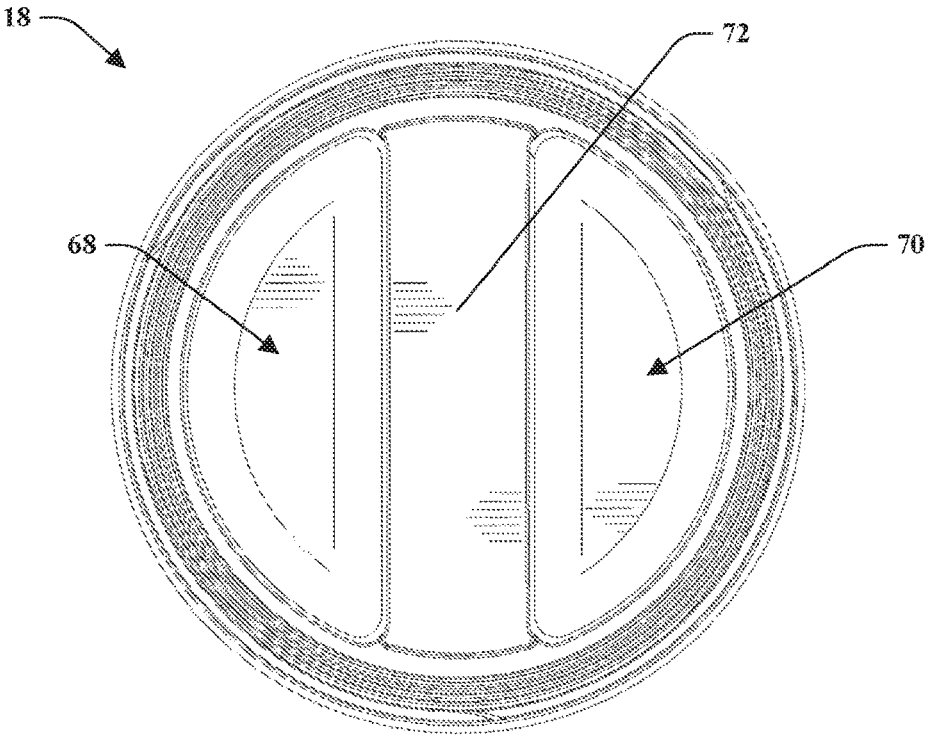
FIG. 30 illustrates an embodiment of a lid.
Figure 31:
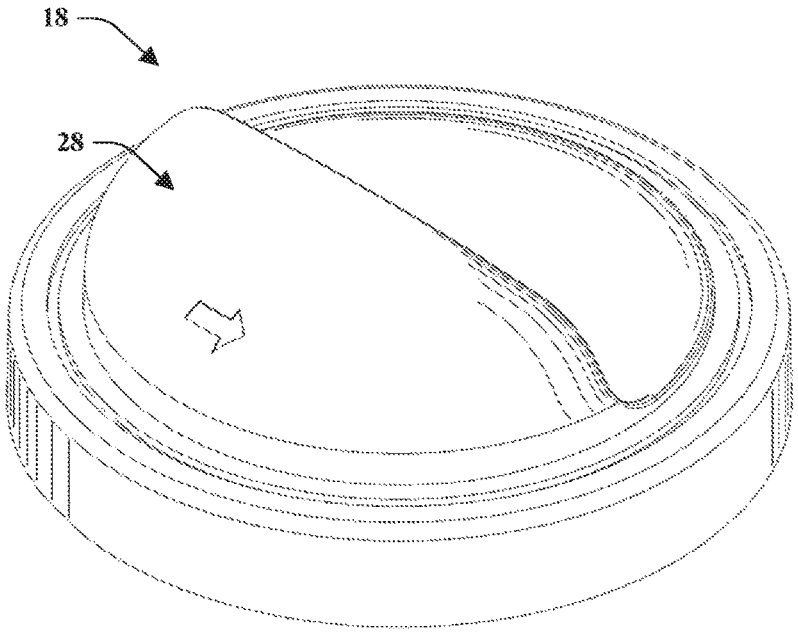
FIG. 31 illustrates an embodiment of a lid.
Figure 32:
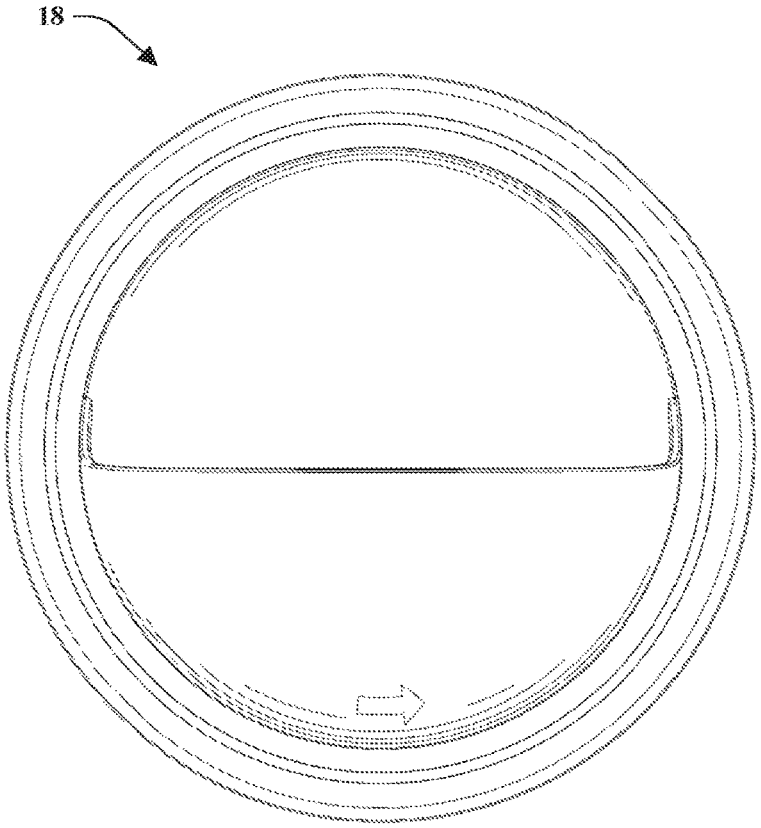
FIG. 32 illustrates an embodiment of a lid.
Figure 33:
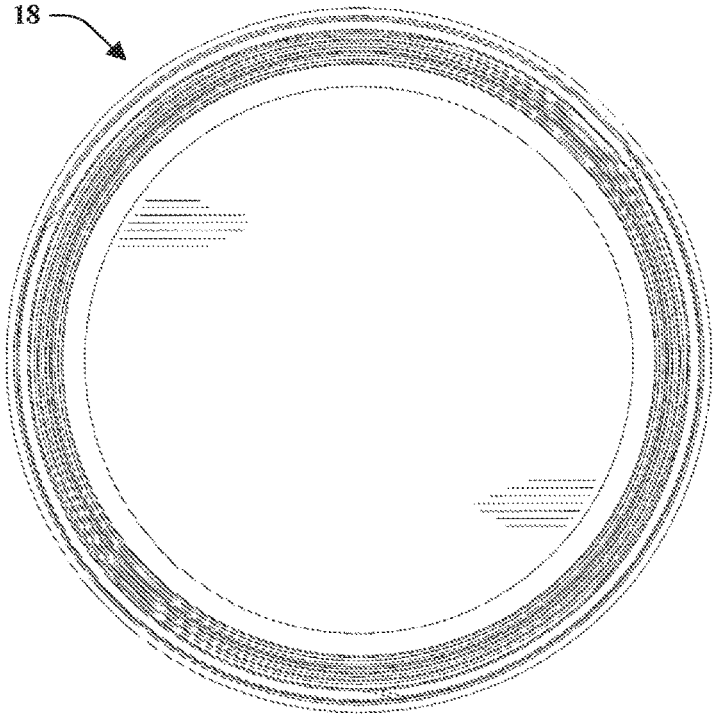
FIG. 33 illustrates an embodiment of a lid.
Figure 34:
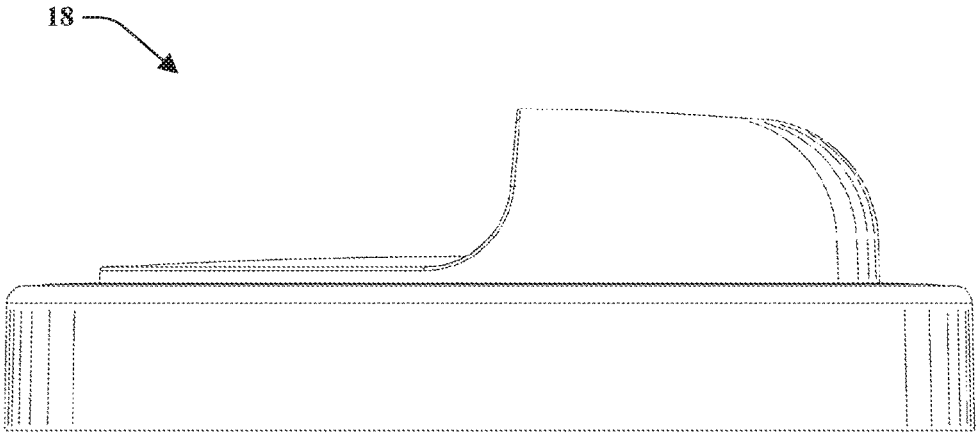
FIG. 34 illustrates an embodiment of a lid.
Figure 35:
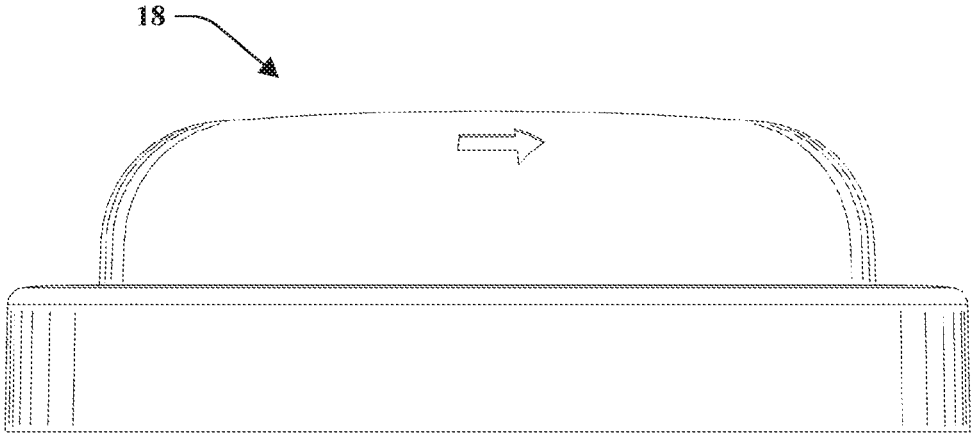
FIG. 35 illustrates an embodiment of a lid.
Figure 36:
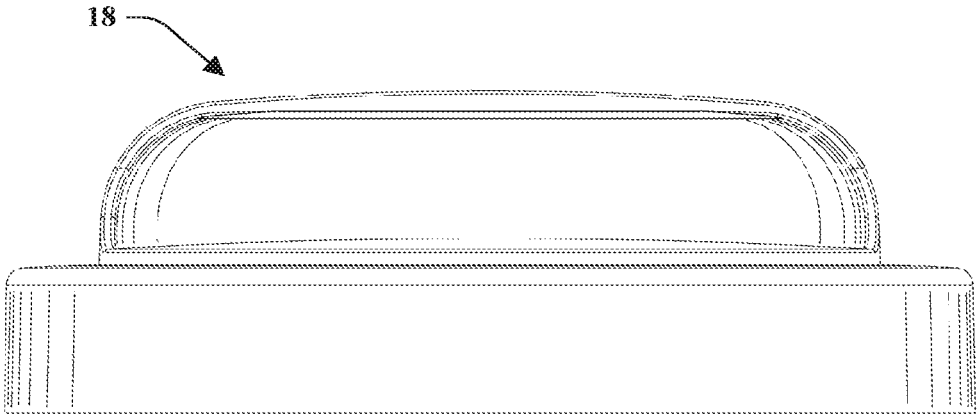
FIG. 36 illustrates an embodiment of a lid.
Figure 37:
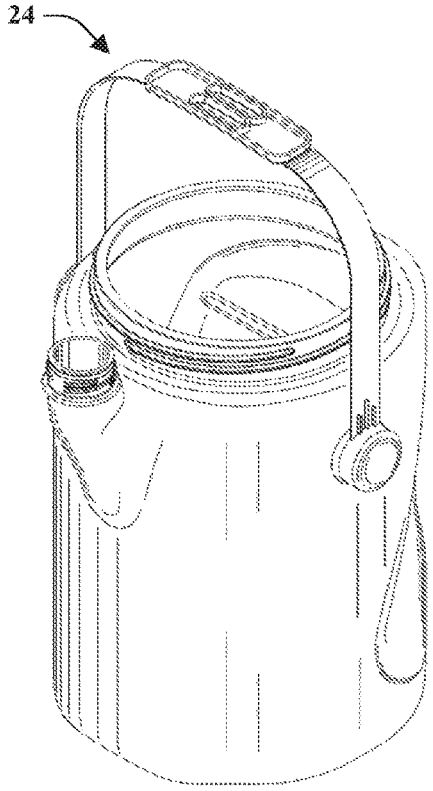
FIG. 37 illustrates an embodiment of a pail-type handle.

As seen in FIG. 30, the bottom side 42 of lid 18 can have two bottom surfaces (68, 70) corresponding to the depressions created by the two recessed areas (64, 66). The bottom side 42 can also include a channel 72 that corresponds to the cavity formed by the built-in handle 20. The channel 72 spans a diameter of the bottom side and separates the two bottom surfaces (68, 70).

Another embodiment of lid 18 can include a depressing force on the built-in handle wall sides 58 in order to release one or more locking tabs on the inside of the lid 18 which disengage the tabs from the outside collar 88 of the first opening 36.

FIGS. 31-36 illustrate another embodiment of the lid 18 that includes the raised handle 28 that is attached to the top side 40 of the lid 18. A base of the raised handle 28 is mounted to the annular rim 46 and extends around a portion of the annular rim 46. In certain embodiments, the base of the raised handle 28 extends around approximately 180° of the annular rim 46. In other embodiments, the base of the raised handle 28 can extend around more than or less than 180° of the annular rim 46. The raised handle 28 extends inwards from the annular rim 46 as a dome structure. The dome structure ends as a straight open end 74 that spans across a diameter of the top side 40. The raised handle 28 partially encloses a recess large enough for a user's fingers to grip. In an embodiment, an arrow 58 can be located on the raised handle 28 to indicate a direction for the lid 18 to be turned in order to open or close the lid 18.

FIGS. 21-25 illustrate an embodiment of the cap 16. Cap 16 can include ridges along the exterior circumference of the cap 16. These ridges provide improved grip for a user when the cap 16 is being screwed on or off the spout 14.

FIGS. 43-47 illustrate a storage container 10 in accordance with the subject innovation. The storage container 10 can include a lid 18 (for example as shown in FIGS. 48-56) that can include more than one positions that enable locking or unlocking of the lid to open or close the storage container 10. In particular, the lid 18 can be configured to expose/cover the first opening 36 and also include an integrated cap 90 that covers second opening 38. For example, the lid can include one or more respective notches on an inside edge of the lid 18 that mate with corresponding recesses or guides on the collar or rim of the first opening 36. The one or more notches can allow for a first position that is used to affix the lid 18 and a twisting or turning motion to move the notches through the recesses or guides. The location of the guides or recesses can include one or more positions to allow for locking, unlocking, or a position of the lid 18 there between. For instance, the lid 18 can be configured to have a first position that is aligned with the second opening 38 to close the container 10 and a second position of the lid 18 approximately 90 degrees from the first position that exposes the second opening 38 and allows removal of the lid 18 from the container 10. It is to be appreciated that when the lid 18 is in a position from closing the second opening 38 to less than 90 degrees, the lid 18 will only allow opening of the second opening 38 and not removal of the lid 18 to expose the first opening 36.

The storage container 10 can further include an integrated handle 22 that is formed with aperture 82 through the container body 12 on a location (e.g., side, front, rear, etc.) between the first end 11 and the second end 13. The aperture 82 separates the integrated handle 22 from the body 12. In an embodiment, the integrated handle 22, the first opening 36, and the second opening 38 are aligned to one another. The second opening 38 and the integrated handle can be aligned but on opposite sides of one another on the body 12. In particular, the second opening 38 can be located on the first end 11 on a front side of the body 12 which is opposite the integrated handle 22 that is located on a backside opposite the front side of the body 12. In other words, the second opening 38, the integrated handle 22, and the first opening 36 can be aligned to one another such that a center of the first opening 36, a center of the second opening 38, and a center of the integrated handle lie in the same geometric plane.

In an embodiment, the aperture 82 is orthogonal to the geometric plane in which the center of the first opening 36, the center of the second opening 38, and the center of the integrated handle 22 lie. The aperture 82 includes a top, a bottom opposite the top, a handle side, and a body side. The top of the aperture 82 is proximate to the first end 11 and the bottom of the aperture 82 is proximate to the second end 13. It is to be appreciated that the aperture 82 can be a shape that allows for receipt of a hand, fingers, or a portion thereof to facilitate holding the storage container 10.

The aperture 82 can be a shape such as, but not limited to, rounded-rectangle, a square, a rectangle, a pill-shape, a circular shape, a rounded polygon, a rounded rectangle, cucumber-shaped, eggplant-shaped, among others. For example, the shape of the aperture 82 can be a rounded pill-shape in which each end has a diameter. The top of the aperture 82 can have a portion of a first diameter and the bottom having a portion of a second diameter, wherein the first diameter is less than the second diameter. In such rounded pill-shape for the aperture 82, the distance between the body side and the handle side can be uniform, increasing from top to bottom, or decreasing from top to bottom.

The integrated handle 22 lies within a cross-section of the container 10 as defined by the sidewalls 80. In other words, the integrated handle 22 does not extend beyond the sidewalls of the container 10. The integrated handle 22 is formed by the aperture 82 and includes a handle top 102, a handle bottom 104, grip section 106 in between the handle top 102 and the handle bottom 104. The grip section 106 can be a shape such as, but not limited to, circular, rounded, rectangular with rounded edges, oval, among others. The grip section 106 is generally rounded in shape and can include a uniform or varying diameter from the handle top 102 to the handle bottom 104. In particular, the diameter of the grip section 106 can be an increasing diameter from the handle top 102 to the handle bottom 104. In another embodiment, the grip section 106 can include a decreasing diameter from the handle top 102 to the handle bottom 104. The handle top 102 connects with the first end 11 and the handle bottom 104 connects with the second end 13. The aperture 82 separates the grip section 106 from the body 12, and in particular, the grip section 106 from the body side of aperture 82.

The handle top 102 can include a first curved portion and a second curved portion opposite thereof for the connection to the first end 11. The curved portions create the handle top 102 of the integrated handle 22. Similarly, the handle bottom 104 can include a first curved portion and a second curved portion opposite thereof for the connection to the second end 13. The curved portions create the handle bottom 104 of the integrated handle 22. For example, the curved portions for the handle top 102 and the handle bottom 104 can be parabolic shaped.

Figure 48:
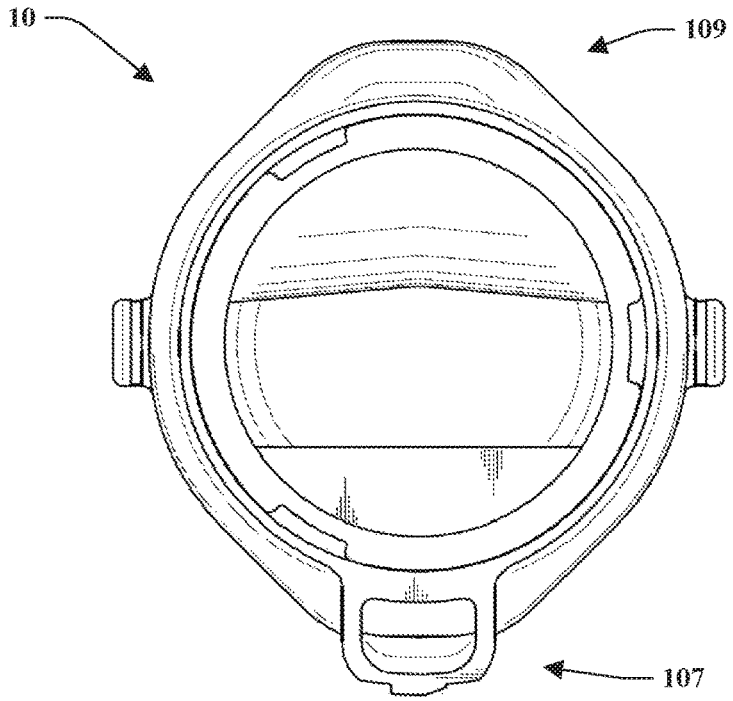
FIG. 48 illustrates an embodiment of a storage container.

As described above, the container 10 in FIGS. 43-49 can have a generally prolate spheroid shape. The top view of the container 10 is illustrated in FIG. 48 which is also showing the first end 11. The below describes the shape of the container from a top view. The front side on the first end 11 includes the second opening 38 that extends from the body 12 providing a shape of a front curve 107. The back side on the first end 11 includes the integrated handle 22 and provides a shape of a back curve 109 opposite the front curve 107. The left side of the first end 11 is generally rounded in shape and connects between a portion of the back curve 109 to a portion of the front curve 107. The right side of the first end 11 is opposite the left side and is generally rounded in shape to connect between a portion of the back curve 109 to a portion of the front curve 107. It is to be appreciated that the left side and the right side can be mirror-images of one another. It is to be appreciated that the front curve 107 and the back curve 109 can be similar in shape but vary in size due to the second opening 38 extending from the body 12 and the shape of the second opening 38 being different than the integrated handle 22.

Figure 49:
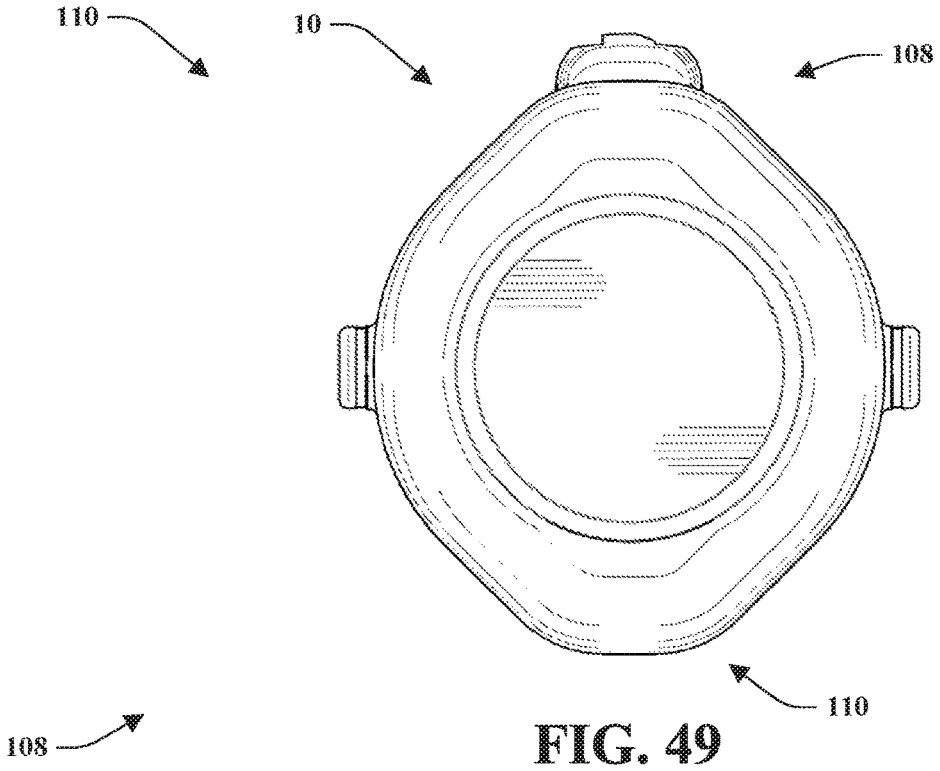
FIG. 49 illustrates an embodiment of a storage container.
Figure 50:
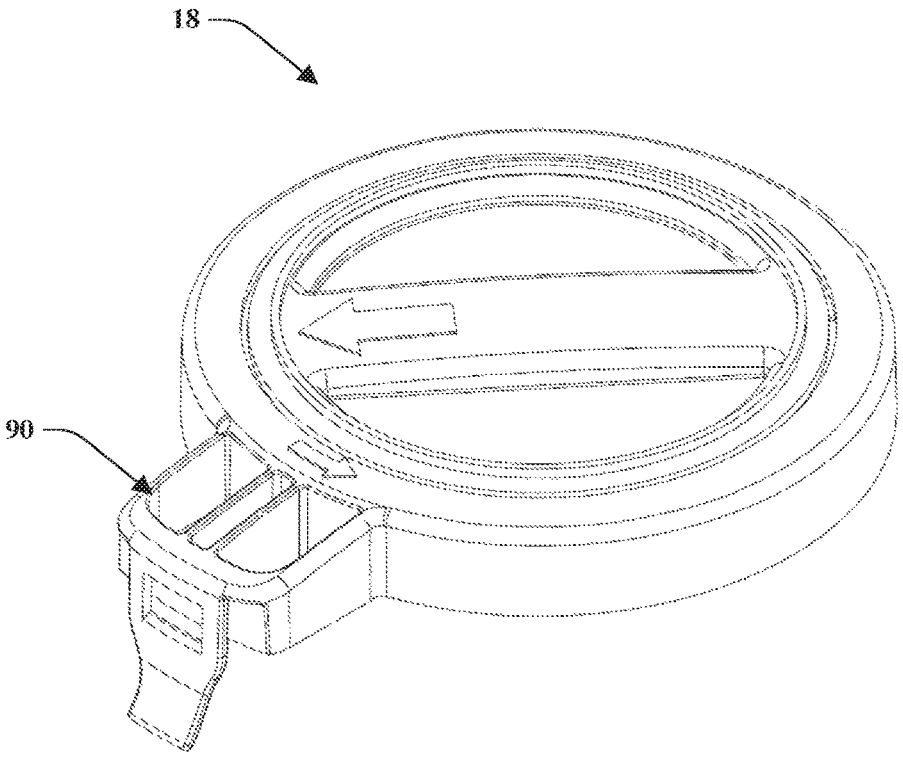
FIG. 50 illustrates an embodiment of a lid.
Figure 51:
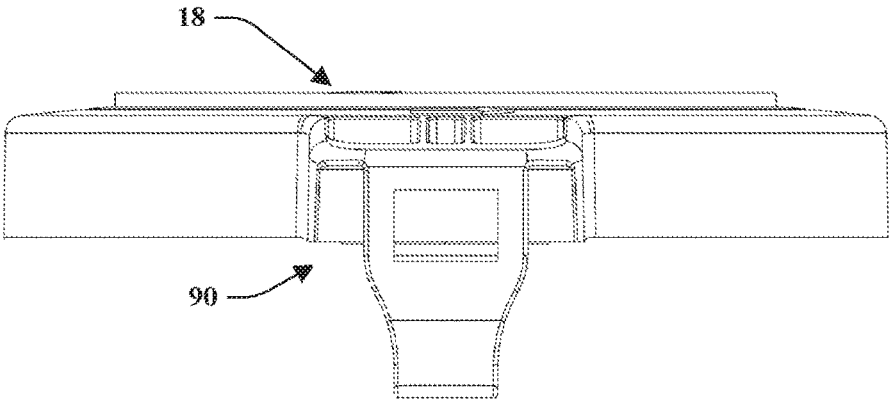
FIG. 51 illustrates an embodiment of a lid.
Figure 52:
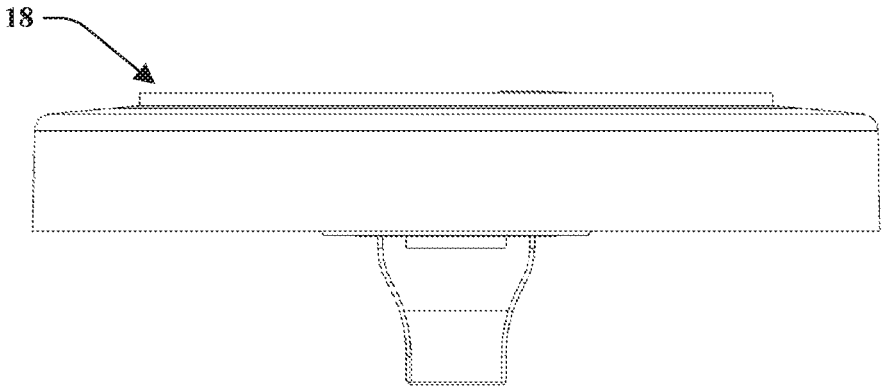
FIG. 52 illustrates an embodiment of a lid.
Figure 53:
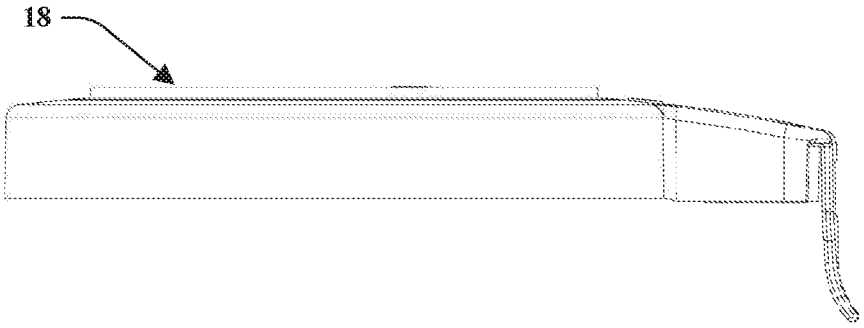
FIG. 53 illustrates an embodiment of a lid.
Figure 54:
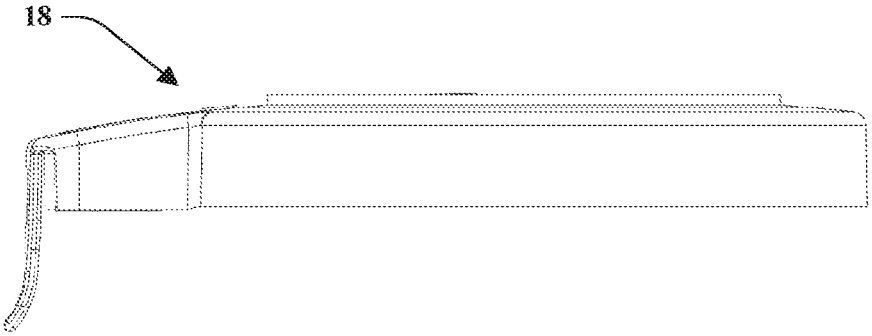
FIG. 54 illustrates an embodiment of a lid.
Figure 55:
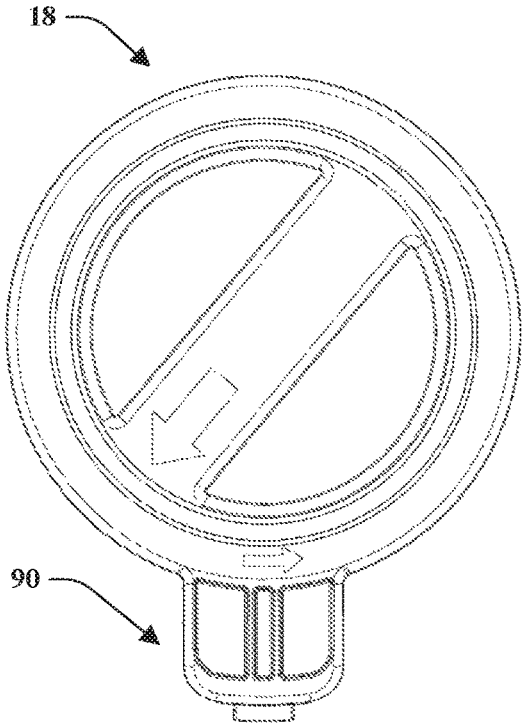
FIG. 55 illustrates an embodiment of a lid.
Figure 56:
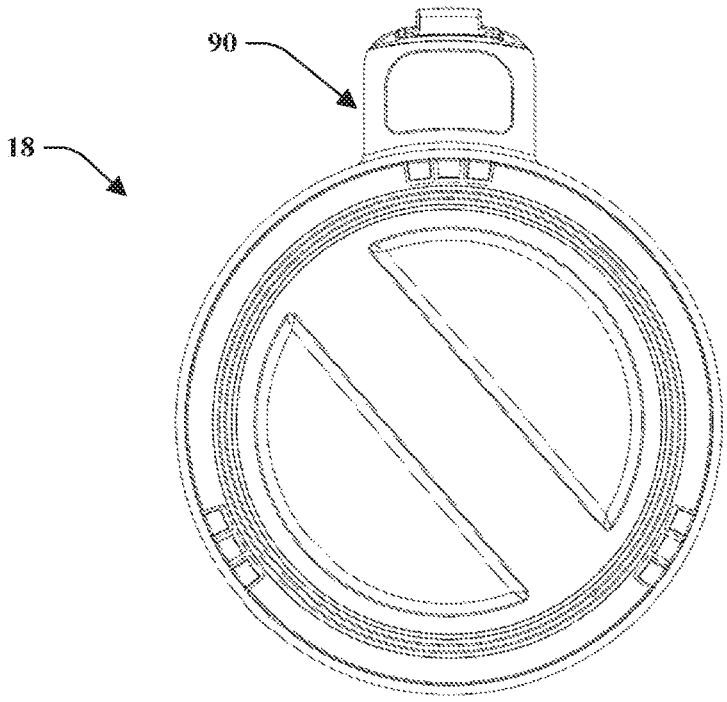
FIG. 56 illustrates an embodiment of a lid.

The bottom view of the container 10 is illustrated in FIG. 49 which is also showing the second end 13. The below describes the shape of the container from a bottom view. The front side on the second end 13 provides a shape of a front curve 108. The back side on the second end 13 includes the integrated handle 22 and provides a shape of a back curve 110 opposite the front curve 108. The left side on the second end 13 is generally rounded in shape and connects between a portion of the back curve 110 to a portion of the front curve 108. The right side on the second end 13 is opposite the left side and is generally rounded in shape to connect between a portion of the back curve 110 to a portion of the front curve 108. It is to be appreciated that the left side and the right side can be mirror-images of one another.

In this embodiment, the second opening 38 can be rectangle in shape or a rounded rectangle shape. The second opening 38 can include a neck portion that couples to a transition portion that extends from the body 12 proximate to the first end 11. The neck portion can be a rectangle in shape and the transition section 84 can be generally a pyramid shape in which a top of the pyramid is positioned toward the second end 13 and the base of the pyramid is positioned toward the first end 11. The neck portion connects to a corner of the base of the pyramid that is extended from the sidewall of the body 12.

As discussed above, the container 10 in FIGS. 43-49 is illustrated and can include one or more ridges or ribs 60 on an interior surface of the body side of the aperture 82 located on the back side of the container 10. The one or more ridges or ribs 60 can be used to receive a roller or other applicator device (e.g., paint brush, roller, stain brush, among others), wherein the rib or ridges 60 facilitate application or removal of the material stored in the storage container 10 to be applied to a roller or other applicator device.

The storage container 10 can include an inside ledge 15 (shown in at least FIG. 43) that can be used to remove material from an applicator device that is being used to apply the material. The inside ledge 15 can be used to remove excess paint from a paint applicator or protect material from exiting the container 10 while both the first opening 36 and the second opening 38 are uncovered (e.g., no lid 18 and/or no cap).

In an embodiment, the lid 18 can include an integrated cap 90 that covers the first opening 36 and the second opening 38. The integrated cap 90 can be connected to the lid's side wall 44 and extend outward from the lid side wall 44. As discussed above, the lid 18 can be twisted in a circular direction from the second opening 38 to the integrated handle 22 to exposed the second opening 38. The lid 18 can include a tab to secure the integrated cap 90 to the rim or lip of the second opening 38. The features of this embodiment can be applied to any of the lid embodiments described herein.

Figure 61:
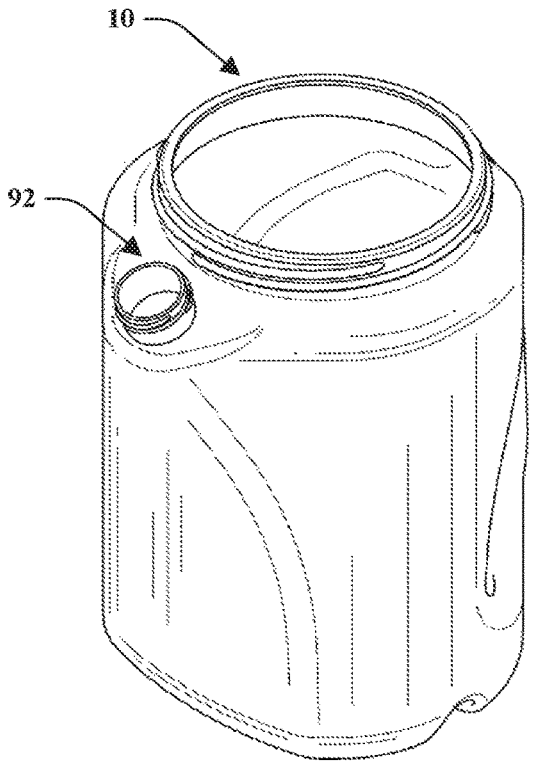
FIG. 61 illustrates a top perspective view of a storage container.
Figure 62:
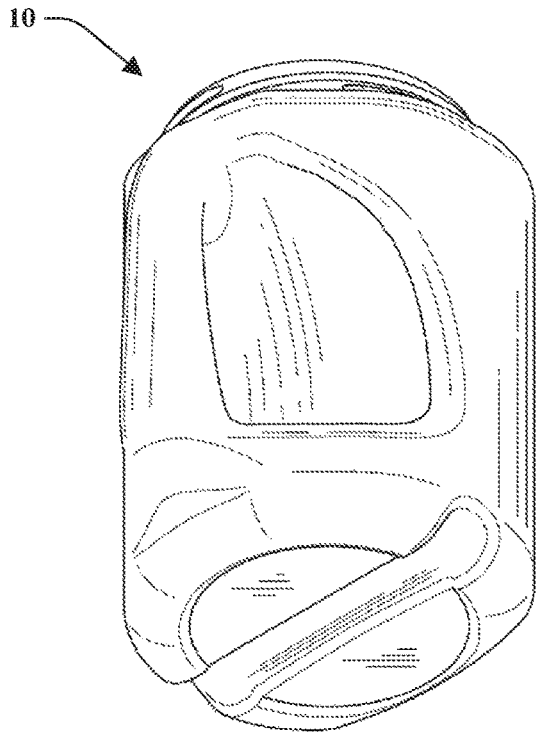
FIG. 62 illustrates a bottom perspective view of a storage container.
Figure 63:
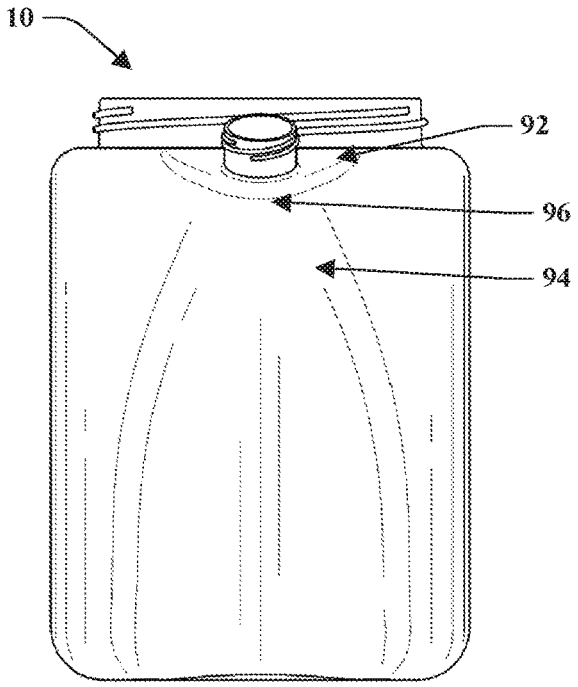
FIG. 63 illustrates a front view of a storage container.
Figure 64:
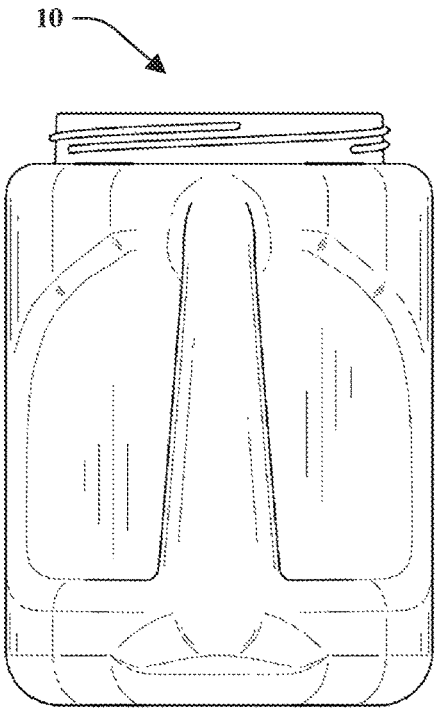
FIG. 64 illustrates a rear view of a storage container.
Figure 65:
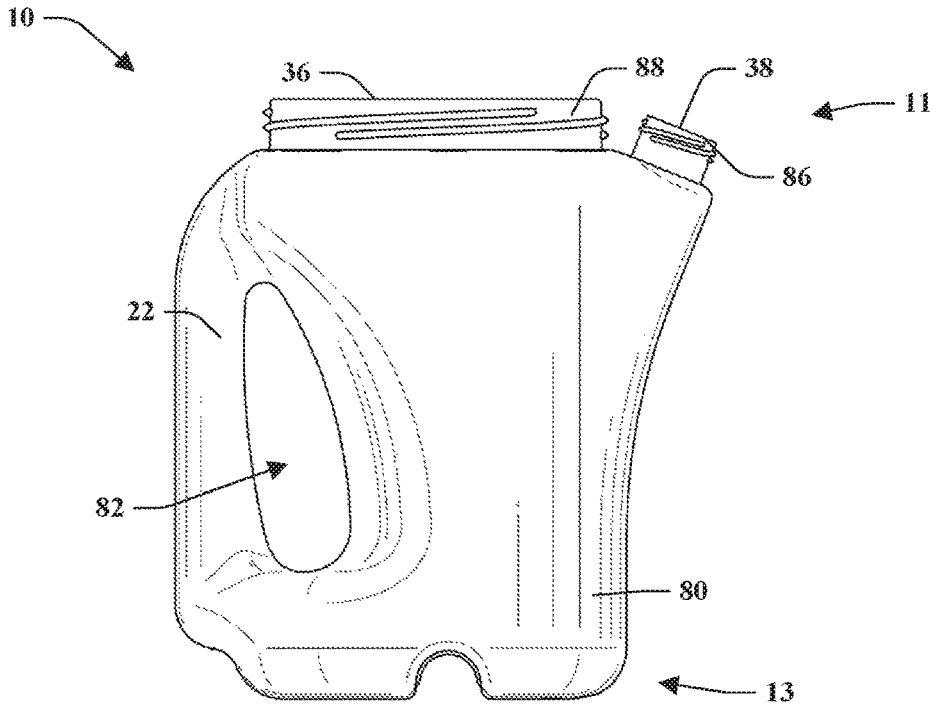
FIG. 65 illustrates a left side view of a storage container.
Figure 66:
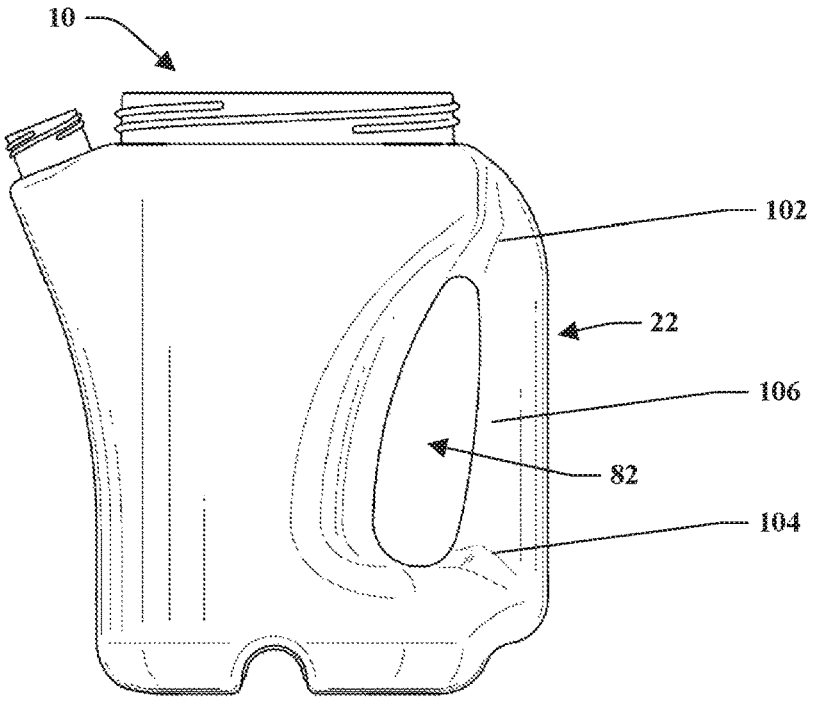
FIG. 66 illustrates a right side view of a storage container.
Figure 67:
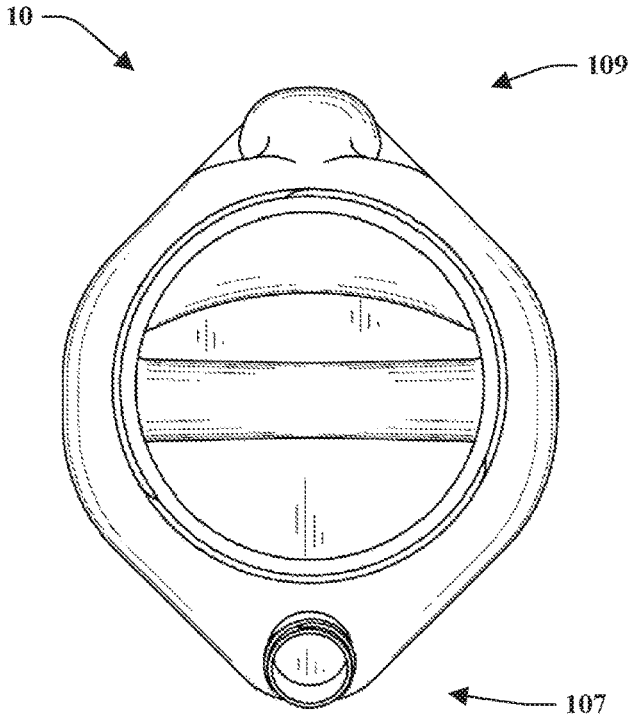
FIG. 67 illustrates a top view of a storage container.
Figure 68:
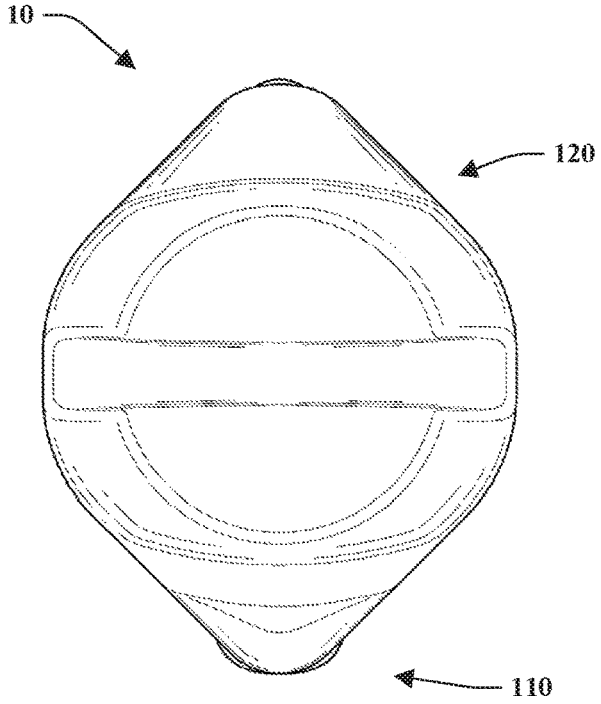
FIG. 68 illustrates a bottom view of a storage container.
Figure 69:
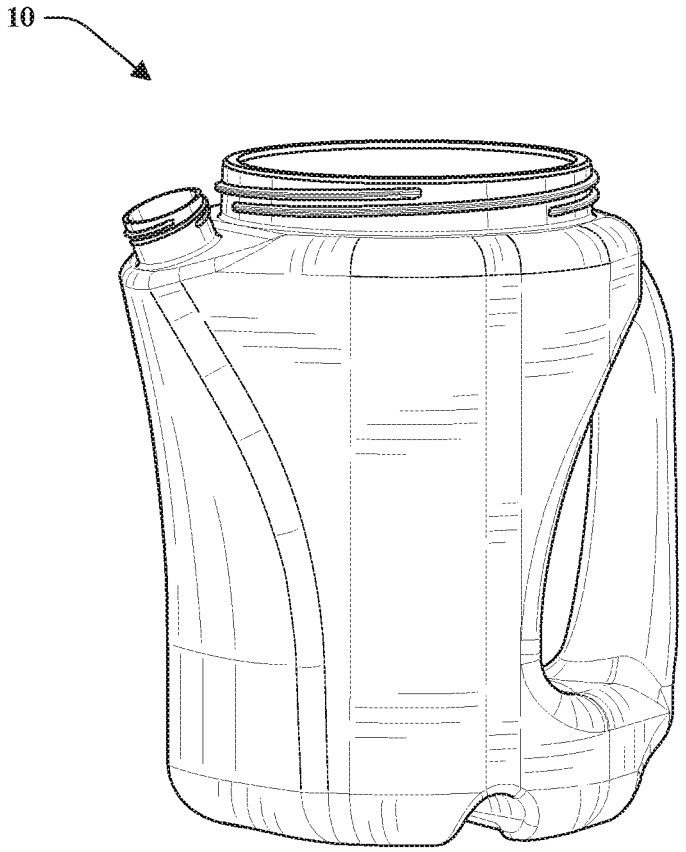
FIG. 69 illustrates an isometric view of a storage container.

FIGS. 57-69 illustrate an embodiment of the storage container 10 in accordance with the subject innovation. In particular, FIG. 61 is a perspective view the storage container 10. FIG. 62 is a rear perspective view of the storage container 10 illustrated in FIG. 61. FIG. 63 is a front view of the storage container illustrated in FIG. 61. FIG. 64 is a rear view of the storage container illustrated in FIG. 61. FIG. 65 is a left side view of the storage container illustrated in FIG. 61. FIG. 66 is a right side view of the storage container illustrated in FIG. 61. FIG. 67 is a top view of the storage container illustrated in FIG. 61. FIG. 68 is a bottom view of the storage container illustrated in FIG. 61. FIG. 69 is an isometric view of a storage container.

The storage container 10 can further include an integrated handle 22 that is formed with aperture 82 through the container body 12 on a location (e.g., side, front, rear, etc.) between the first end 11 and the second end 13. The aperture 82 separates the integrated handle 22 from the body 12. In an embodiment, the integrated handle 22, the first opening 36, and the second opening 38 are aligned to one another. The second opening 38 and the integrated handle can be aligned but on opposite sides of one another on the body 12. In particular, the second opening 38 can be located on the first end 11 on a front side of the body 12 which is opposite the integrated handle 22 that is located on a backside opposite the front side of the body 12. In other words, the second opening 38, the integrated handle 22, and the first opening 36 can be aligned to one another such that a center of the first opening 36, a center of the second opening 38, and a center of the integrated handle lie in the same geometric plane. Moreover, a top of a collar 88 for the first opening 36 can be situated on a first geometric plane that is at zero (0) degrees and a top of the lip 86 of the second opening 38 can be situated on a second geometric plane that is X negative degrees from the first geometric plane, where X is a positive integer. In particular, the second geometric plane can be −5 degree to −45 degrees from the first geometric plane.

In an embodiment, the aperture 82 is orthogonal to the geometric plane in which the center of the first opening 36, the center of the second opening 38, and the center of the integrated handle 22 lie. The aperture 82 includes a top, a bottom opposite the top, a handle side, and a body side. The top of the aperture 82 is proximate to the first end 11 and the bottom of the aperture 82 is proximate to the second end 13. It is to be appreciated that the aperture 82 can be a shape that allows for receipt of a hand, fingers, or a portion thereof to facilitate holding the storage container 10.

The aperture 82 can be a shape such as, but not limited to, rounded-rectangle, a square, a rectangle, a pill-shape, a circular shape, a rounded polygon, a rounded rectangle, cucumber-shaped, eggplant-shaped, among others. For example, the shape of the aperture 82 can be a rounded pill-shape in which each end has a diameter. The top of the aperture 82 can have a portion of a first diameter and the bottom having a portion of a second diameter, wherein the first diameter is less than the second diameter. In such rounded pill-shape for the aperture 82, the distance between the body side and the handle side can be uniform, increasing from top to bottom, or decreasing from top to bottom.

The integrated handle 22 is formed by the aperture 82 and includes a handle top 102, a handle bottom 104, grip section 106 in between the handle top 102 and the handle bottom 104. The grip section 106 can be a shape such as, but not limited to, circular, rounded, rectangular with rounded edges, oval, among others. The grip section 106 is generally rounded in shape and can include a uniform or varying diameter from the handle top 102 to the handle bottom 104. In particular, the diameter of the grip section 106 can be an increasing diameter from the handle top 102 to the handle bottom 104. In another embodiment, the grip section 106 can include a decreasing diameter from the handle top 102 to the handle bottom 104. The handle top 102 connects with the first end 11 and the handle bottom 104 connects with the second end 13. The aperture 82 separates the grip section 106 from the body 12, and in particular, the grip section 106 from the body side of aperture 82.

As described above, the container 10 in FIGS. 57-69 can have a generally prolate spheroid shape. The top view of the container 10 is illustrated in FIG. 67 which is also showing the first end 11. The below describes the shape of the container from a top view. The front side on the first end 11 includes the second opening 38 and has a flat shape 120. The back side on the first end 11 includes the integrated handle 22 and provides a back curve 109 opposite the flat shape 120. The left side on the first end 11 is generally rounded in shape and connects between a portion of the back curve 109 to a portion of the flat shape 120. The right side on the first end 11 is opposite the left side and is generally rounded in shape to connect between a portion of the back curve 109 to a portion of the flat shape 120. It is to be appreciated that the left side and the right side can be mirror-images of one another.

The bottom view of the container 10 is illustrated in FIG. 68 which is also showing the second end 13. The below describes the shape of the container from a bottom view. The front side on the second end 13 includes the second opening 38 that extends from the body 12 providing a flat shape 120. The back side on the second end 13 includes the integrated handle 22 which provides a back curve 110 opposite the flat shape 120. The left side on the second end 13 is generally rounded in shape and connects between a portion of the back curve 110 to a portion of the front curve 108. The right side on the second end 13 is opposite the left side and is generally rounded in shape to connect between a portion of the back curve 110 to a portion of the front curve 108. It is to be appreciated that the left side and the right side can be mirror-images of one another.

In this embodiment, the second opening 38 can be circular or rounded shape. The second opening 38 is formed by a lip 86 that is connected to a flat surface area 92 on the front side of the first end 11. A spout area 94 is on the front side of the container body 12. The spout area protrudes outwardly from the sidewall of the container body 12 to create a spout shape 96 at a location on the flat surface area 92. The flat surface area 92 can be on a substantially similar geometric plane (e.g., the second geometric plane) as the second opening 38.

Figure 57:
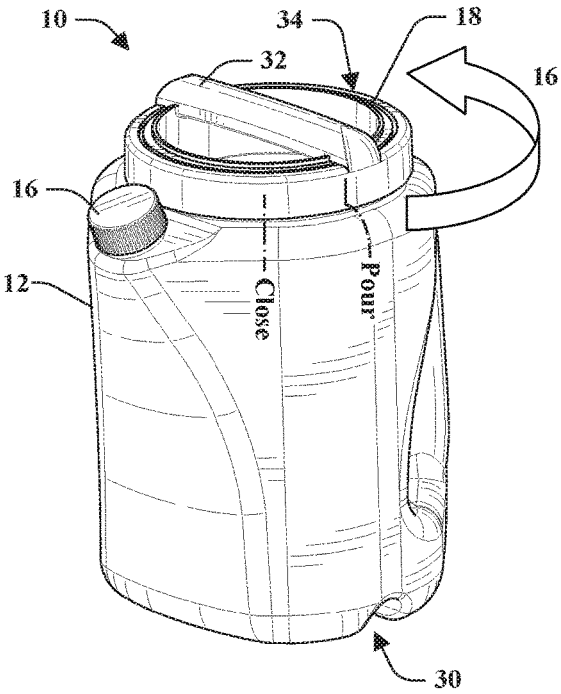
FIG. 57 illustrates an embodiment of a storage container.
Figure 58:
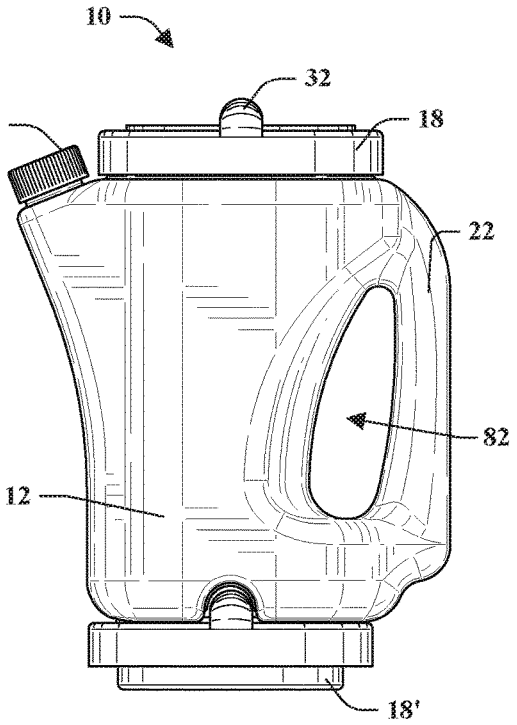
FIG. 58 illustrates an embodiment of a storage container.
Figure 59:
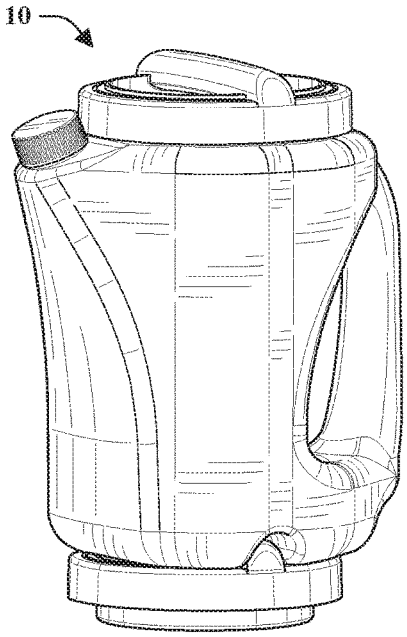
FIG. 59 illustrates an embodiment of a storage container.
Figure 60:
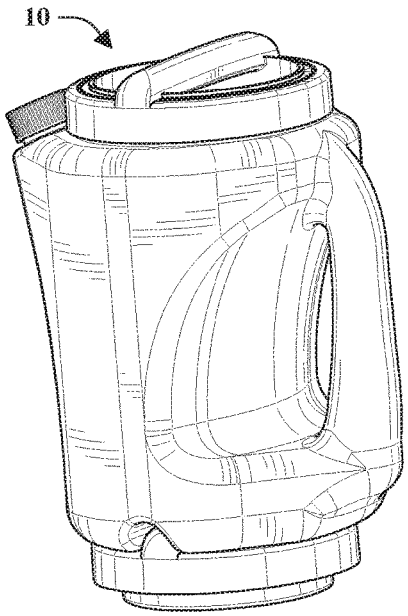
FIG. 60 illustrates an embodiment of a storage container.

FIG. 57 is a perspective view of the storage container 10 and FIG. 58 is a right side view of the storage container 10 (of which the left side view is a mirror-image thereof). The storage container 10 includes a lid 18 having a topside handle 32, wherein the topside handle 32 is raised above the annular rim 36 of the lid 18 as illustrated in FIG. 58. The topside handle 32 can include a shape and design such that a portion of the bottom side (e.g., underside or second end 13) of the storage container 10 can match or mate with such design to facilitate stacking two or more storage containers. In particular, FIG. 58 further illustrates an indent feature 30 on a bottom of the storage container 10 that mates with and/or is configured to receive a raised feature 32. The indent feature 30 can be any shape or size such that when the storage container 10 having the indent feature 30 is stacked onto a topside of another storage container, the lid 18 and topside handle 32 will mate and/or engage with the indent feature 30 which facilitates stacking of multiple storage containers. This stacking is useful during transport, display, packing/packaging, among others. In this example, the raised handle 32 is a cylinder shape rung and the indent feature 30 is a channel. In particular, the lid 18 can include a male shape for the topside handle 32 and the bottom side can include a corresponding female shape to which the male shape fits to the female shape.

The front side of the storage container 10 (e.g., below the second opening and/or cap 16) can include a flat portion as illustrated in FIG. 57 that begins at the second end 13 toward the spout area 94. The flat portion transitions to an outward curve to meet the spout area 94 and flat surface area 92.

As discussed above, the lid 18 can include an integrated cap in which a first position can be configured for pouring and a second position can be configured for closing.

Figure 70:
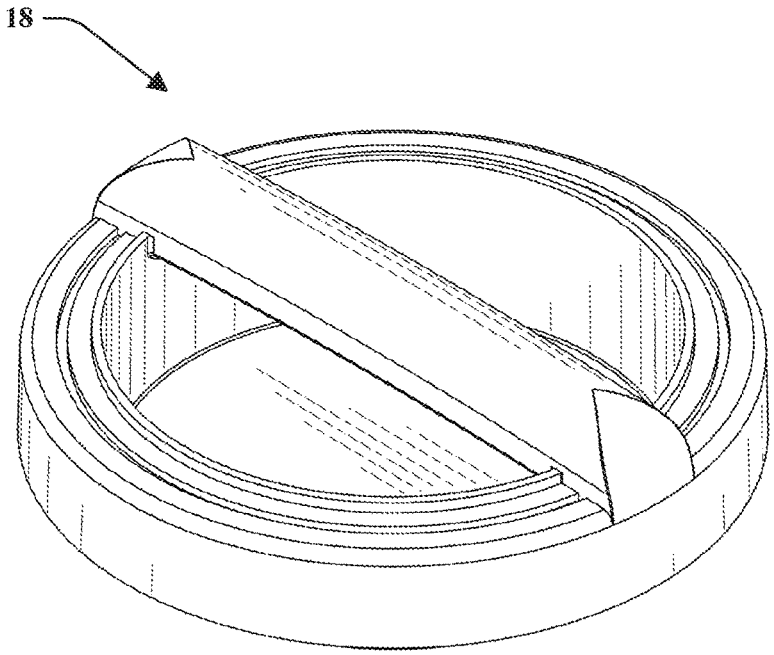
FIG. 70 illustrates a top perspective view of a lid.
Figure 71:
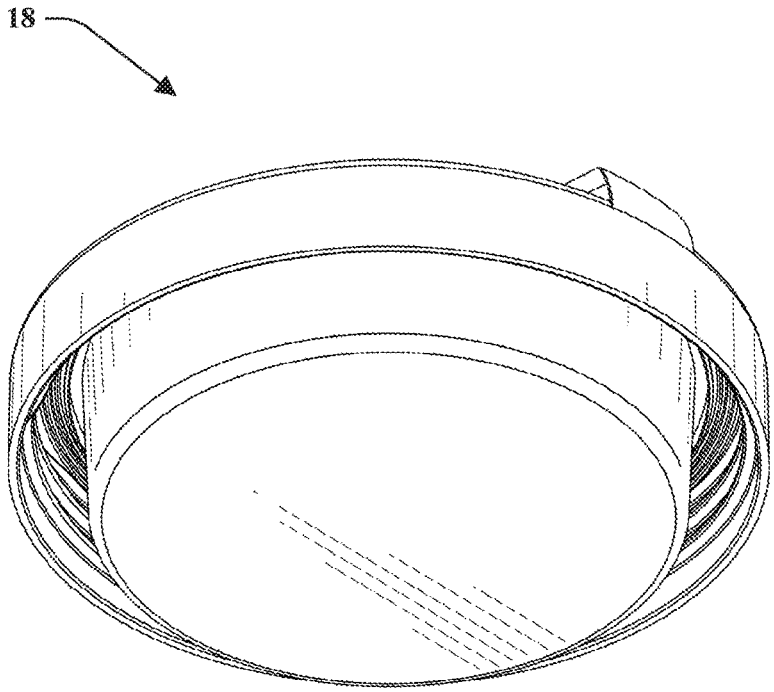
FIG. 71 illustrates a bottom perspective view of a lid.
Figure 72:
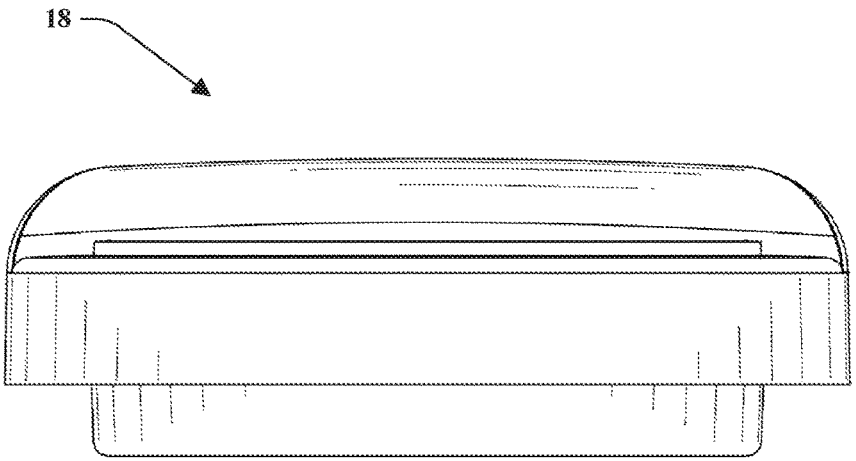
FIG. 72 illustrates a front view of a lid.
Figure 73:
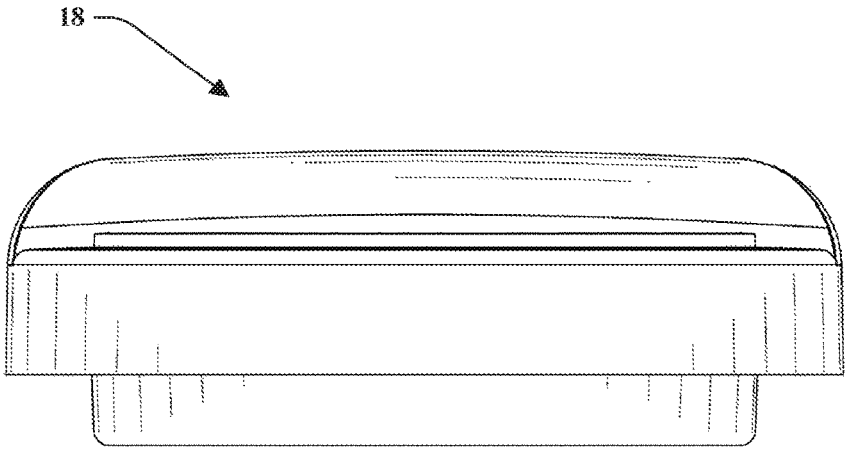
FIG. 73 illustrates a rear view of a lid.
Figure 74:
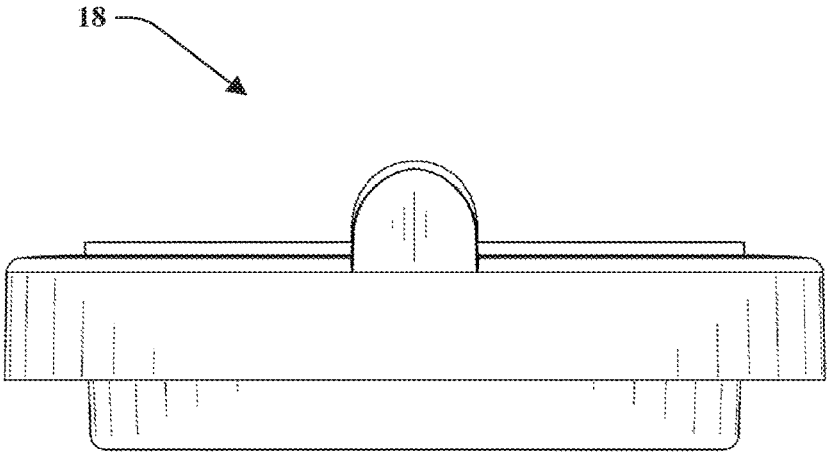
FIG. 74 illustrates a left side view of a lid.
Figure 75:
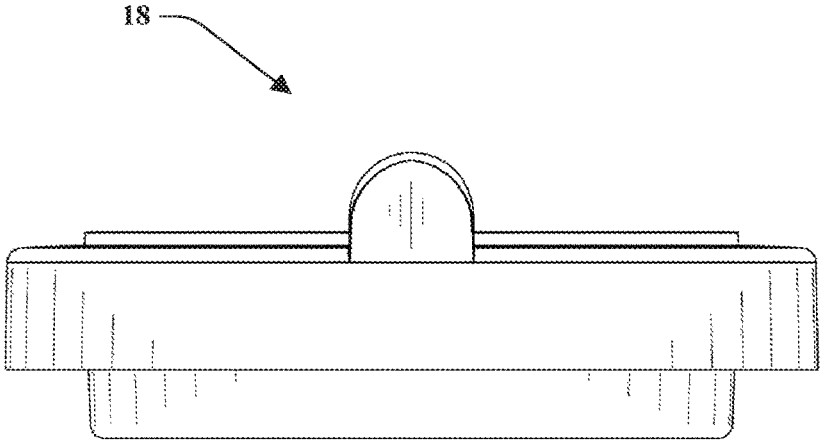
FIG. 75 illustrates a right side of a lid.
Figure 76:
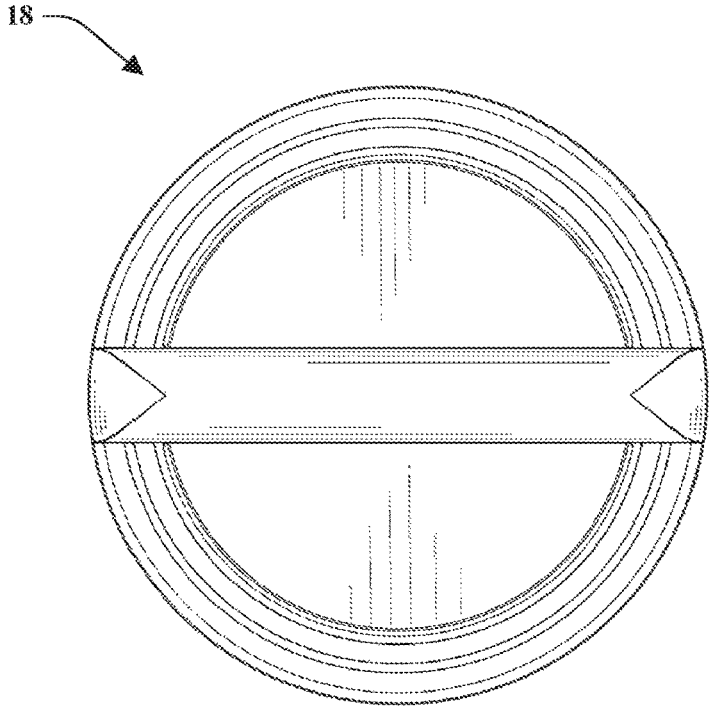
FIG. 76 illustrates a top view of a lid.
Figure 77:
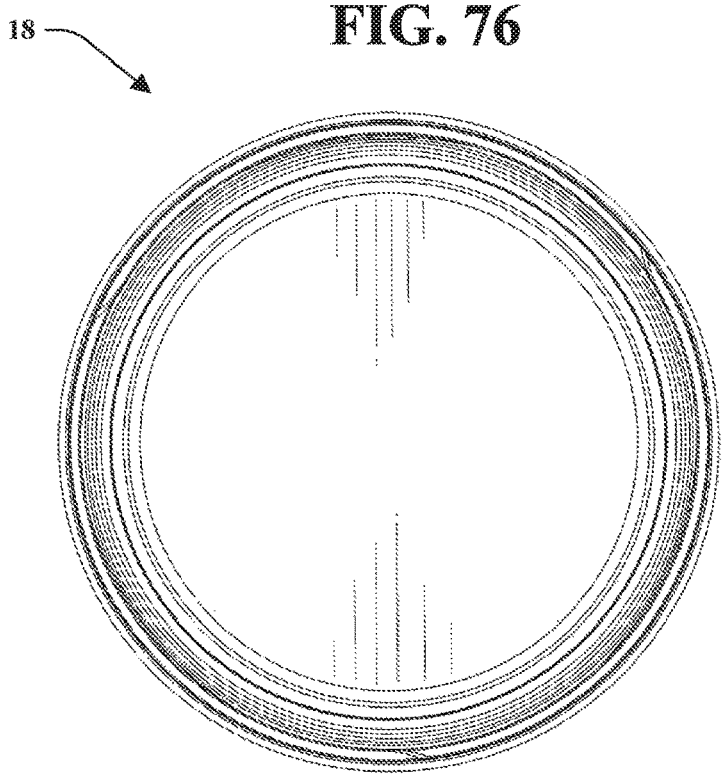
FIG. 77 illustrates a bottom view of a lid.

FIGS. 70-77 illustrate a lid in accordance with the subject innovation and include the features of the lid 18 as described with reference to FIGS. 57-58 above. FIG. 70 is a top perspective view of a lid 18 for the storage container 10. FIG. 71 is a bottom perspective view of the lid 18 illustrated in FIG. 70. FIG. 72 is front view of the lid 18 illustrated in FIG. 70. FIG. 73 is a rear view of the lid 18 illustrated in FIG. 70. FIG. 74 is a left side view of the lid 18 illustrated in FIG. 70. FIG. 75 is a right side view of the lid 18 illustrated in FIG. 70. FIG. 76 is a top view of the lid 18 illustrated in FIG. 70 with the left side being a mirror image thereof. FIG. 77 is a bottom view of the lid 18 illustrated in FIG. 70.

Figure 78:
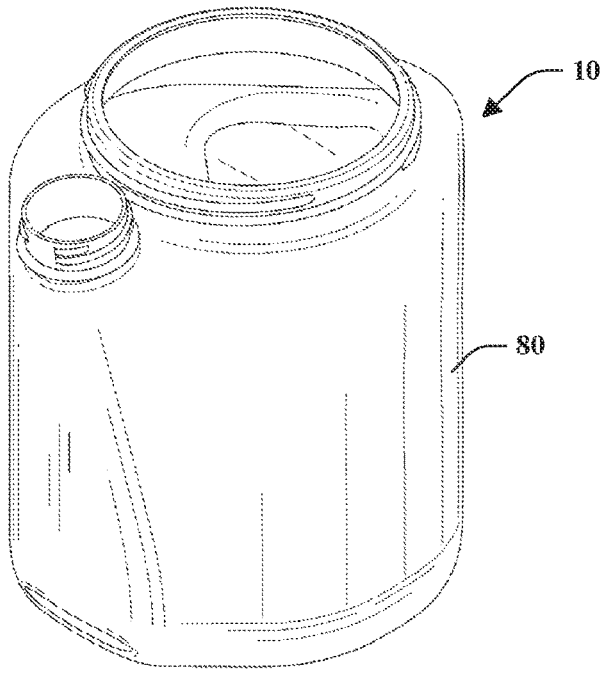
FIG. 78 is a perspective view a storage container.
Figure 79:
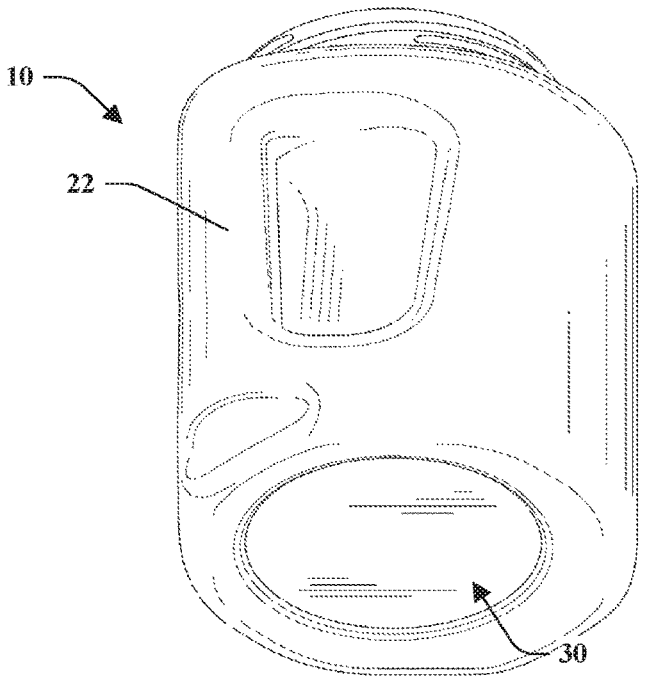
FIG. 79 is a rear perspective view of a storage container.
Figure 80:
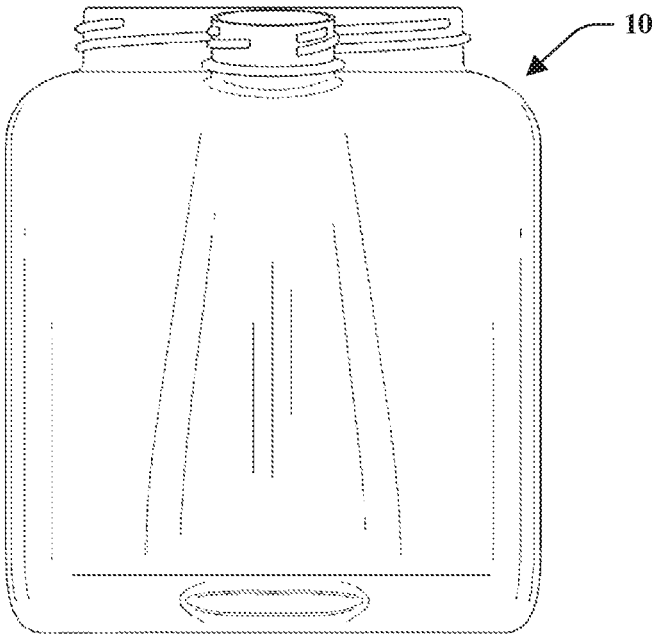
FIG. 80 is a front view of a storage container.
Figure 81:
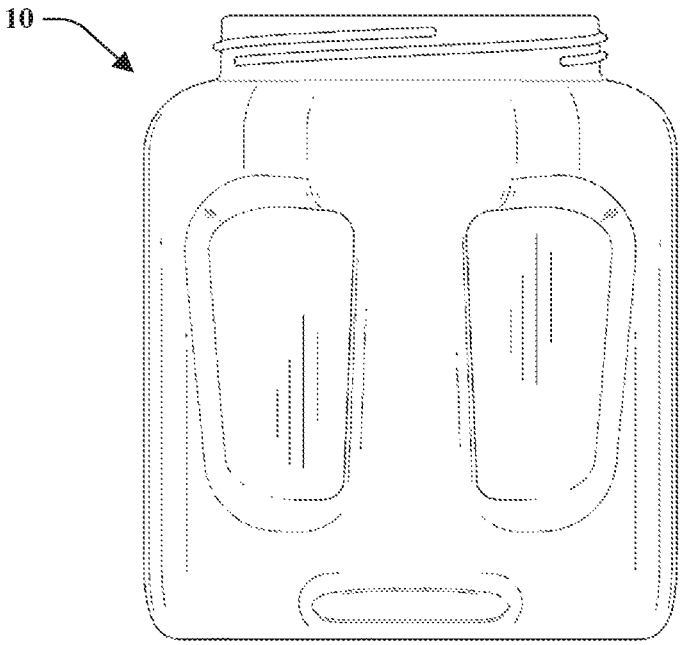
FIG. 81 is a rear view of a storage container.
Figure 82:
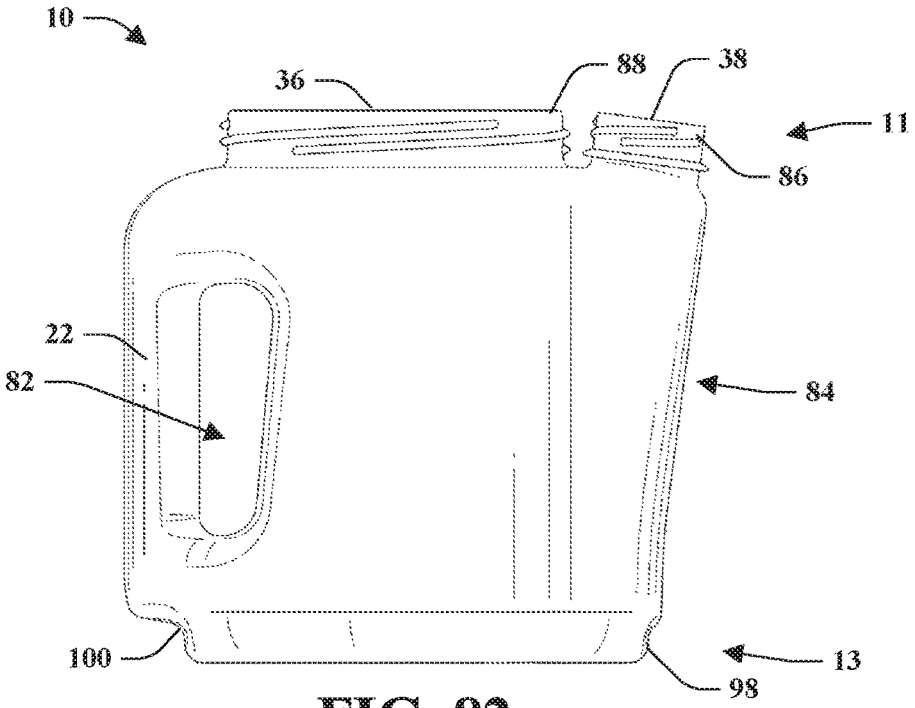
FIG. 82 is a left side view of a storage container.
Figure 83:
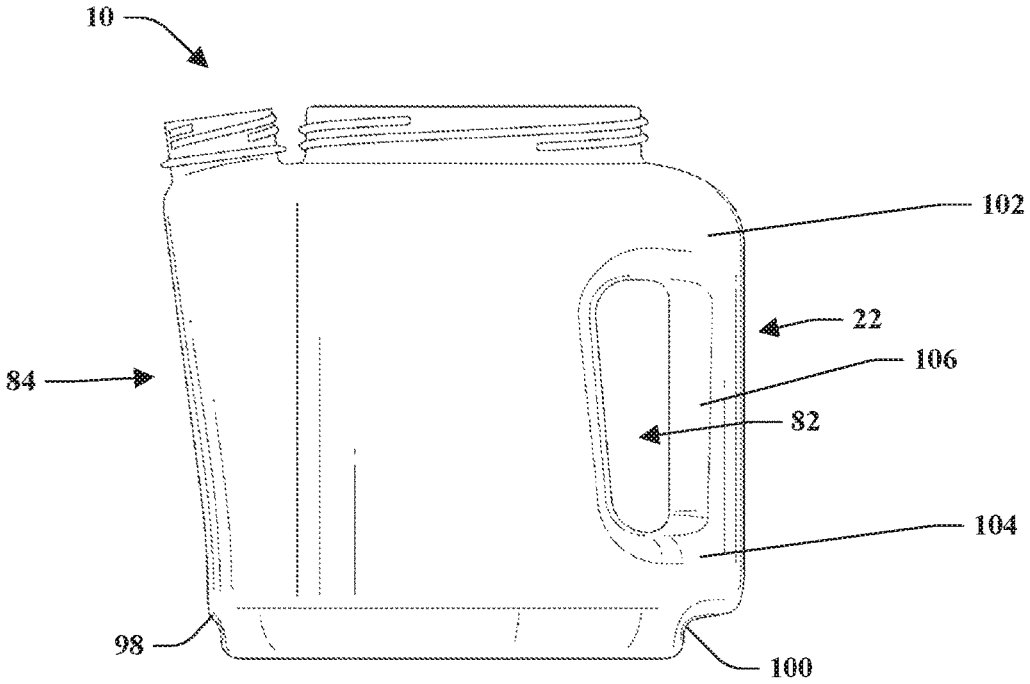
FIG. 83 is a right side view of a storage container.
Figure 84:
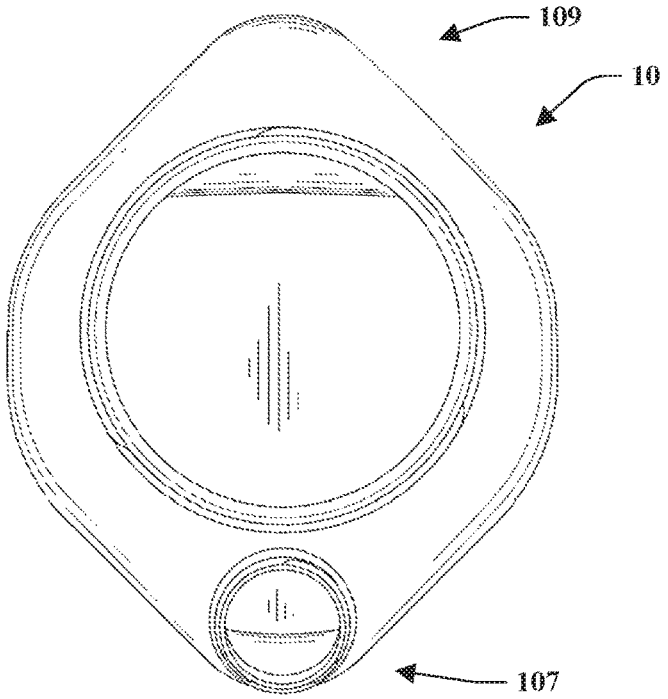
FIG. 84 is a top view of a storage container.
Figure 85:
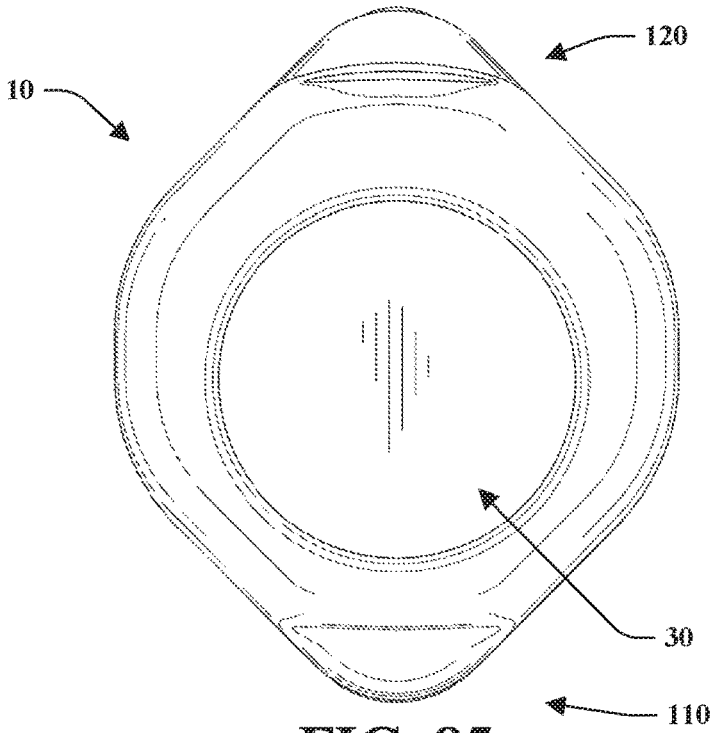
FIG. 85 is a bottom view of a storage container.

FIGS. 78-85 illustrate a storage container 10 in accordance with the subject innovation. In particular, FIG. 78 is a perspective view the storage container 10. FIG. 79 is a rear perspective view of the storage container 10 illustrated in FIG. 78. FIG. 80 is a front view of the storage container illustrated in FIG. 78. FIG. 81 is a rear view of the storage container illustrated in FIG. 78. FIG. 82 is a left side view of the storage container illustrated in FIG. 78. FIG. 83 is a right side view of the storage container illustrated in FIG. 78. FIG. 84 is a top view of the storage container illustrated in FIG. 78. FIG. 85 is a bottom view of the storage container illustrated in FIG. 78.

Figure 86:
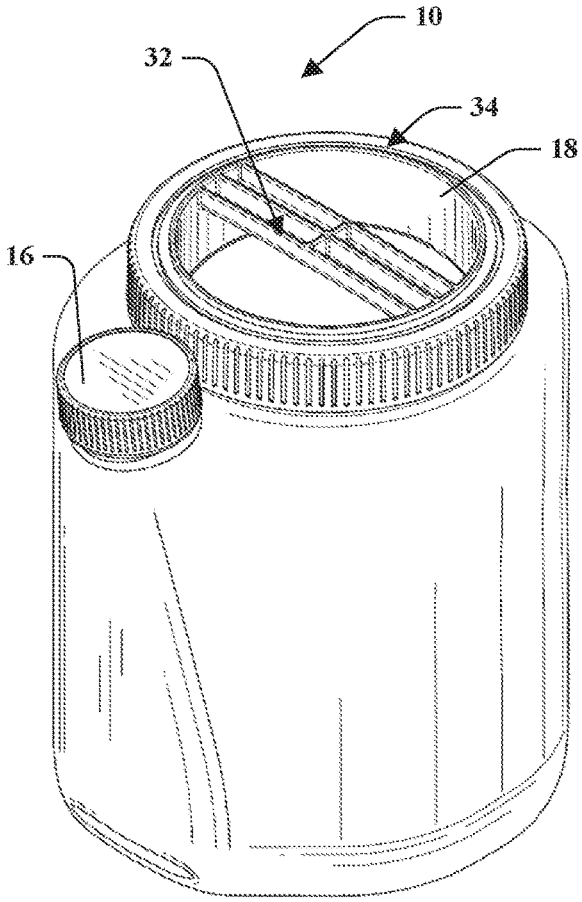
FIG. 86 illustrates a storage container having a lid 18 and a cap 16 for the first opening and the second opening respectively.
Figure 87:
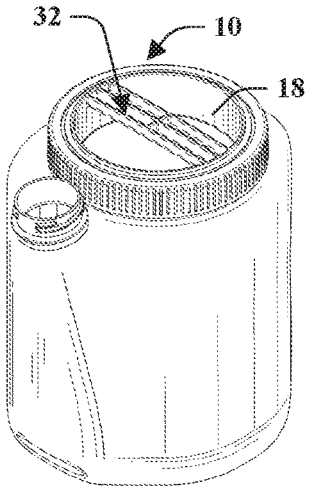
FIG. 87 illustrates a storage container with the cap removed to expose the second opening.
Figure 88:
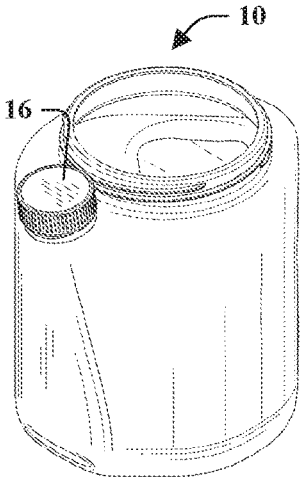
FIG. 88 illustrates a storage container 10 with a lid removed to expose the first opening.

FIG. 86 illustrates the storage container 10 having a lid 18 and a cap 16 for the first opening and the second opening respectively. In particular, the storage container 10 can include a first opening that can be accessible with a removable lid 18 and the second opening can be accessible with a cap 16, wherein the first opening is larger in diameter or shape in comparison to the second opening. The first opening can be used to pour or as an access port or spout for the contents that are housed by the storage container 10. FIG. 87 illustrates the storage container 10 with the cap 16 removed to expose the second opening. FIG. 88 illustrates the storage container 10 with the lid 18 removed to expose the first opening.

Figure 89:
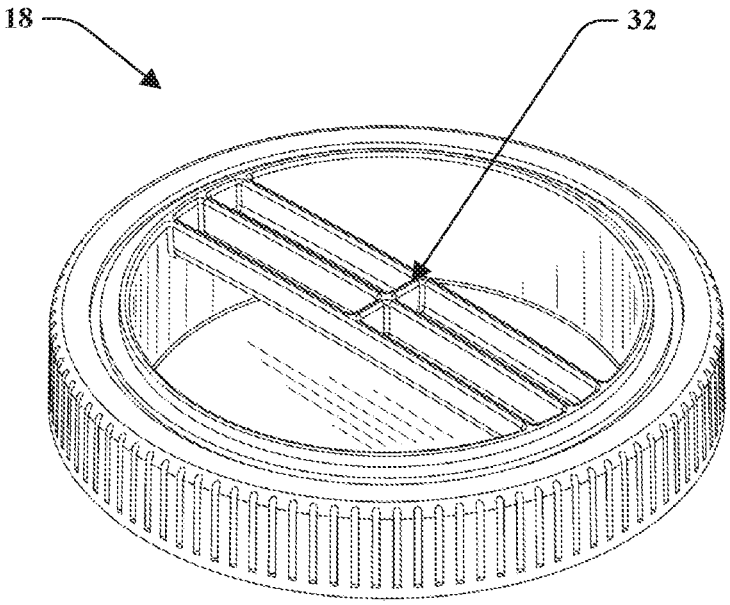
FIG. 89 is a top perspective view of a lid for a storage container.
Figure 90:
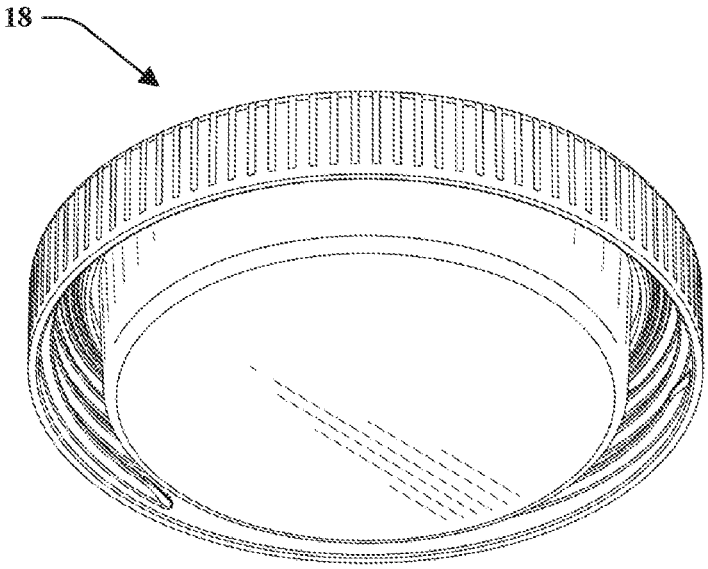
FIG. 90 is a bottom perspective view of a lid.
Figure 91:
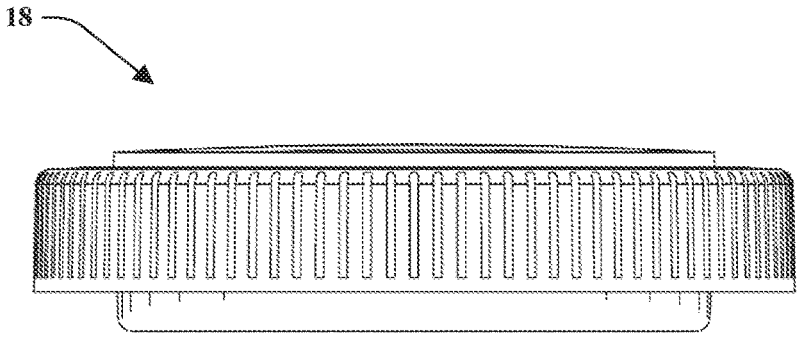
FIG. 91 is front view of a lid.
Figure 92:
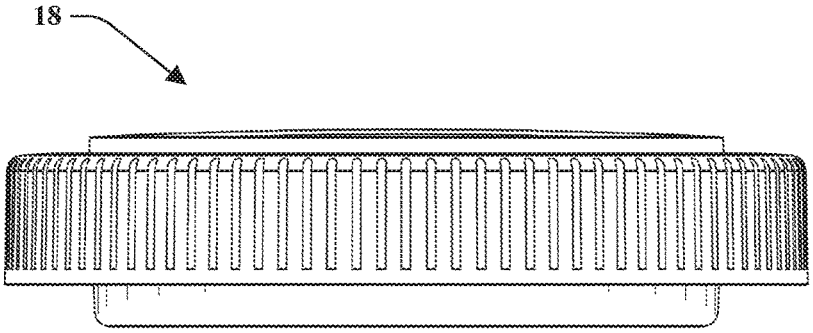
FIG. 92 is a rear view of a lid.
Figure 93:
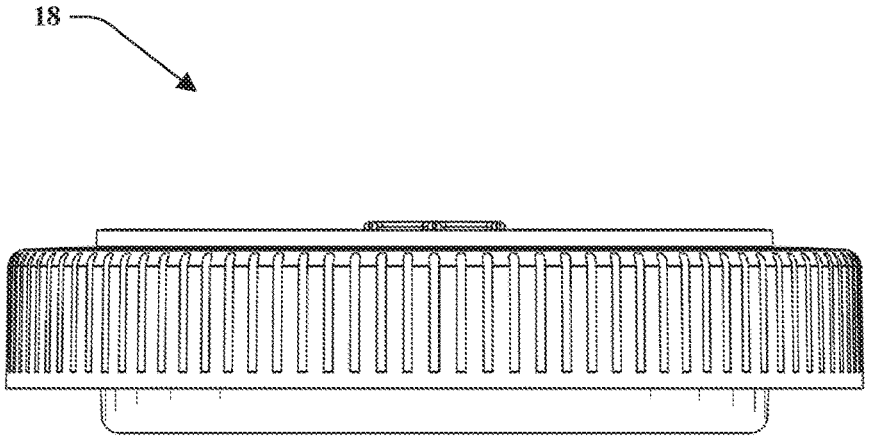
FIG. 93 is a left side view of a lid.
Figure 94:
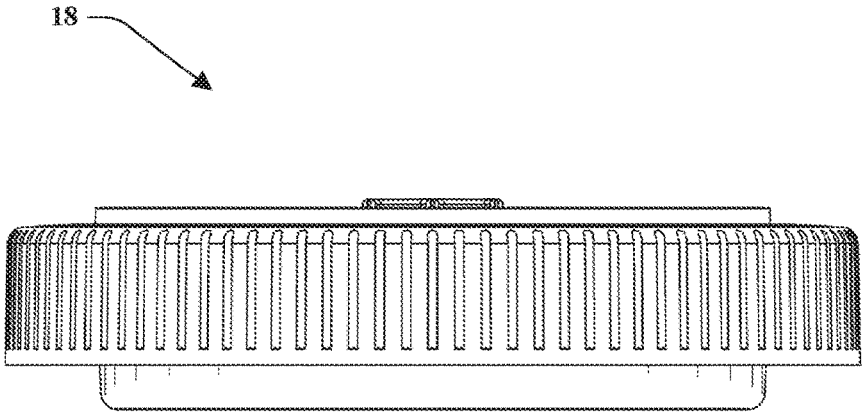
FIG. 94 is a right side view of a lid.
Figure 95:
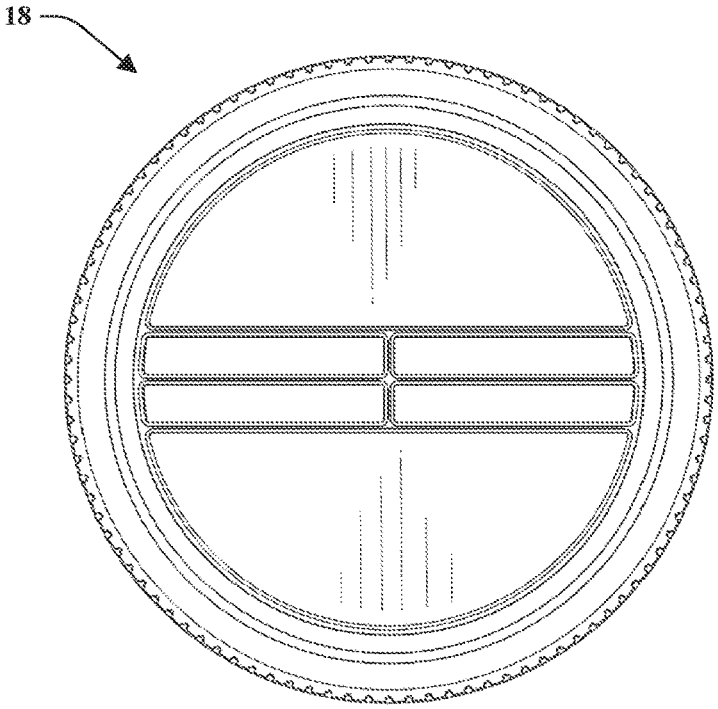
FIG. 95 is a top view of a lid with the left side being a mirror image thereof.
Figure 96:
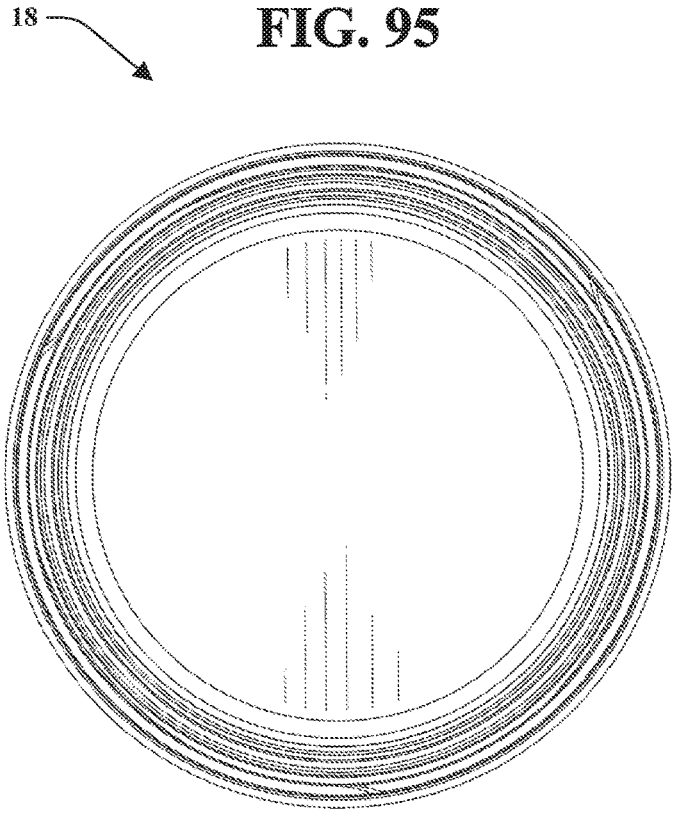
FIG. 96 is a bottom view of a lid.

FIGS. 89-96 illustrate a lid in accordance with the subject innovation that can be used with any embodiment described herein of the storage container 10. FIG. 89 is a top perspective view of a lid 18 for the storage container 10. FIG. 90 is a bottom perspective view of the lid 18 illustrated in FIG. 89. FIG. 91 is front view of the lid 18 illustrated in FIG. 89. FIG. 92 is a rear view of the lid 18 illustrated in FIG. 89. FIG. 93 is a left side view of the lid 18 illustrated in FIG. 89. FIG. 94 is a right side view of the lid 18 illustrated in FIG. 89. FIG. 95 is a top view of the lid 18 illustrated in FIG. 89 with the left side being a mirror image thereof. FIG. 96 is a bottom view of the lid 18 illustrated in FIG. 89.

The embodiment of FIGS. 78-89 of the storage container 10 and embodiment of FIGS. 90-96 of the lid 18 are described below. The storage container 10 includes a lid 18 having a topside handle 32 (shown in at least FIGS. 86, 87, and 89), wherein the topside handle 32 is depressed below the annular rim 46 of the lid 18 as illustrated in FIGS. 86, 87, and 89. The topside handle 32 can include a shape and design such that a bottom portion of the storage container 10 can match or mate with such design to facilitate stacking two or more storage containers. In particular, the bottom of the storage container 10 shown in FIG. 85 can include an indent feature 30 (shown in FIGS. 79 and 85), wherein the indent feature allows the lid 18 or a portion of the lid 18 to mate therewith. The indent feature 30 can be any shape or size such that when the storage container 10 having the indent feature 30 is stacked onto a topside of another storage container, the lid 18 and topside handle 32 will mate and/or engage with the indent feature 30 which facilitates stacking of multiple storage containers. This stacking is useful during transport, display, packing/packaging, among others.

The second end 13 can further include a front side notch 98 located on the front side of the container 10. The second end can further include a back side notch 100 located on the side of the container 10. The front side notch 98 and the back side notch 100 can facilitate stacking an additional container above or below the container 10. In particular, the front side notch 98 and the back side notch 100 can allow a space or area for a second opening of an additional container to be placed or situated. In particular, the indent feature 30 can be used to mate with a lid 18 of a first opening 36 on an additional container and at least one of the front side notch 98 or the back side notch 100 can mate with the cap 16 of a second opening 38 on the additional container.

The storage container 10 can include a first opening that can be accessible with a removable lid 18 and the second opening can be accessible with a cap 16, wherein the first opening is larger in diameter or shape in comparison to the second opening. In general, the second opening can be used to pour contents from the storage container 10 and the first opening can be used to access the inside of the storage container 10 or pour the contents from a larger opening.

The front side of the storage container 10 (e.g., below the second opening and/or cap 16) can include a flat portion as illustrated in FIGS. 78, 82, and 83. The flat portion can project forward at an angle from the bottom portion of the container. The top and bottom portions of the body 12 can include a beveled edge or rounded edge.

FIGS. 78-88 illustrate an embodiment of the container 10 that can include an integrated handle 22 that is formed with aperture 82 through the container body 12 on a location (e.g., side, front, rear, etc.) between the first end 11 and the second end 13. The aperture 82 separates the integrated handle 22 from the body 12. In an embodiment, the integrated handle 22, the first opening 36, and the second opening 38 are aligned to one another. The second opening 38 and the integrated handle can be aligned but on opposite sides of one another on the body 12. In particular, the second opening 38 can be located on the first end 11 on a front side of the body 12 which is opposite the integrated handle 22 that is located on a backside opposite the front side of the body 12. In other words, the second opening 38, the integrated handle 22, and the first opening 36 can be aligned to one another such that a center of the first opening 36, a center of the second opening 38, and a center of the integrated handle lie in the same geometric plane. Moreover, a top of the collar 88 of the first opening 36 can be situated on a first geometric plane that is at zero (0) degrees and a top of the lip 86 of the second opening 38 can be situated on a second geometric plane that is X negative degrees from the first geometric plane, where X is a positive integer. In particular, the second geometric plane can be −1 degree to −20 degrees from the first geometric plane.

In an embodiment, the aperture 82 is orthogonal to the geometric plane in which the center of the first opening 36, the center of the second opening 38, and the center of the integrated handle 22 lie. The aperture 82 includes a top, a bottom opposite the top, a handle side, and a body side. The top of the aperture 82 is proximate to the first end 11 and the bottom of the aperture 82 is proximate to the second end 13. It is to be appreciated that the aperture 82 can be a shape that allows for receipt of a hand, fingers, or a portion thereof to facilitate holding the storage container 10.

The aperture 82 can be a shape such as, but not limited to, rounded-rectangle, a square, a rectangle, a pill-shape, a circular shape, a rounded polygon, a rounded rectangle, cucumber-shaped, eggplant-shaped, among others. For example, the shape of the aperture 82 can be a rounded pill-shape in which each end has a diameter. The top of the aperture 82 can have a portion of a first diameter and the bottom having a portion of a second diameter, wherein the first diameter is greater than the second diameter. In such rounded pill-shape for the aperture 82, the distance between the body side and the handle side can be uniform, increasing from top to bottom, or decreasing from top to bottom.

The integrated handle 22 lies within a cross-section of the container 10 as defined by the sidewalls. In other words, the integrated handle 22 does not extend beyond the sidewalls of the container 10. The integrated handle 22 is formed by the aperture 82 and includes a handle top 102, a handle bottom 104, grip section 106 in between the handle top 102 and the handle bottom 104. The grip section 106 can be a shape such as, but not limited to, circular, rounded, rectangular with rounded edges, oval, among others. The grip section 106 is generally rounded in shape and can include a uniform or varying diameter from the handle top 102 to the handle bottom 104. In particular, the diameter of the grip section 106 can be an increasing diameter from the handle top 102 to the handle bottom 104. In another embodiment, the grip section 106 can include a decreasing diameter from the handle top 102 to the handle bottom 104. The handle top 102 connects with the first end 11 and the handle bottom 104 connects with the second end 13. The aperture 82 separates the grip section 106 from the body 12, and in particular, the grip section 106 from the body side of aperture 82.

The handle top 102 can include a first curved portion and a second curved portion opposite thereof for the connection to the first end 11. The curved portions create the handle top 102 of the integrated handle 22. Similarly, the handle bottom 104 can include a first curved portion and a second curved portion opposite thereof for the connection to the second end 13. The curved portions create the handle bottom 104 of the integrated handle 22. For example, the curved portions for the handle top 102 and the handle bottom 104 can be parabolic shaped.

As described above, the container 10 in FIGS. 78-88 can have a generally prolate spheroid shape. The top view of the container 10 is illustrated in FIG. 84 which is also showing the first end 11. The below describes the shape of the container 10 from a top view. The front side of the first end 11 includes the second opening 38 that extends from the body 12 providing a shape of a front curve 107. The back side of the first end 11 includes the integrated handle 22 and provides a shape of a back curve 109 opposite the front curve 107. The left side of the first end 11 is generally rounded in shape and connects between a portion of the back curve 109 to a portion of the front curve 107. The right side of the first end 11 is opposite the left side and is generally rounded in shape to connect between a portion of the back curve 109 to a portion of the front curve 107. It is to be appreciated that the left side and the right side can be mirror-images of one another. It is to be appreciated that the front curve 107 and the back curve 109 can be similar in shape but vary in size due to the second opening 38 extending from the body 12 and the shape of the second opening 38 being different than the integrated handle 22.

The bottom view of the container 10 is illustrated in FIG. 49 which is also showing the second end 13. The below describes the shape of the container from a bottom view. The front side of the second end 13 provides a shape of a front curve 108. The back side of the second end 13 includes the integrated handle 22 and provides a shape of a back curve 110 opposite the front curve 108. The left side of the second end 13 is generally rounded in shape and connects between a portion of the back curve 110 to a portion of the front curve 108. The right side of the second end 13 is opposite the left side and is generally rounded in shape to connect between a portion of the back curve 110 to a portion of the front curve 108. It is to be appreciated that the left side and the right side can be mirror-images of one another.

In this embodiment, the second opening 38 can be circular or rounded shape. The second opening 38 is formed by a lip that is connected to the front side of the first end 11 and the first opening 36 is formed by a collar that is connected to the top of the first end 11. In particular, the first opening 36 and the second opening 38 are situated on the same geometric plane while the tops of the collar and lip are situated in different geometric planes. In still another embodiment, the first opening 36 and the second opening 38 are situated on the different geometric plane separated by a first number of degrees while the tops of the collar and lip are also situated in different geometric planes separated by a second number of degrees.

The second opening 38 can include the lip 86 situated on the front side of the top side of first end 11. The front side can include a transition section 84 that spans from the second end 13 to the first end 11 in a generally pyramid shape in which a top of the pyramid is positioned toward the first end 11 and the base of the pyramid is positioned toward the second end 13. The lip 86 is positioned on the first end 11 proximate to the top of the pyramid.

The second opening 38 can include threads on a lip 86 to allow removable attachment of a cap 16. In an embodiment, the spout 14 or second opening 38 can include an area 62 that does not include a thread(s) so as to be a smooth surface. In other words, the second opening 38 can include a range of degrees or area 62 that do not include a thread or threads so as to reduce material from the storage container 10 collecting on such lip or rim of the second opening 38. For example, a lip 86 can include 360 degrees of threads. In another example, a spacing of a number of degrees can be without threads, wherein the spacing of the number of degrees is along a center line for a center of the second opening 38. With the range of degrees or area 62 on the second opening 38 that do not include a thread or threads, the smooth surface is easier to keep clean or remove/clean material therefrom. This reduces the material causing the cap 16 to be unnecessarily stuck or sticky to the second opening 38 due to build-up of material housed in the storage container 10.

First opening and second opening for lid 18 and cap 16 respectively can include an additional layer of sealing such openings after being filled with contents that are housed by the storage container 10. For example, a sealed tamper device can be used under the lid 18 or the cap 16, wherein the sealed tamper device can be removed by the customer or user before being able to access the contents housed in the storage container 10 via the first opening or the second opening.

The storage container 10 can store, house, hold, or contain any suitable solid, liquid, gas, vapor, or a combination thereof. The storage container can include multiple chambers inside the storage container 10. For example, a first internal chamber can be separated from a second internal chamber, wherein the first internal chamber uses the first opening for access and the second internal chamber uses the second opening for access. For example, a first material can be contained in the first chamber and a second material can be contained in the second chamber to allow separation of the two materials. In another example, the two materials can be related to one another such that one chamber can be a first material and the second is a second material, wherein the first material is dependent or used with the second material or vice versa. For instance, the combination of materials can be, but are not limited to, a primer and a paint, a first paint color and a second paint color related to a design-specific color coordination, a first chemical and a second chemical that create a glue when combined, a first chemical and a second chemical that create a chemical peal or remover, among others.

It is to be appreciated that the storage container 10 can include two or more chambers and/or two or more openings.

In an embodiment and referring to back to FIGS. 1-13 and 37-40, the container 10 can have four parts or less. For example, the container 10 can comprise a blow molded body and 3 or less injection molded parts. The embodiment can meet or exceed paint container design specifications related to traditional paint containers, wherein the design specifications relate to compression, drop test, etc. The material and manufacturing costs for the container 10 can be lower than traditional paint containers. The container 10 can include a pouring spout (e.g., second opening) that allows paint to be poured without having to open the first opening or removing the lid 18. The lid 18 can include an ergonomic grip. The container 10 can include an angled body design with the integrated handle 22 in which from a side perspective or view (e.g., see FIG. 4), the inner angled surface allows a roller to fit inside the container 10 while still allowing the container 10 to have dimensions that fit in a paint shaker. The container 10 can include the bail-type handle 24 that is removeable. If the embodiment does not include the bail-type handle 24, the one or more nodules 26 (also referred to as ears) are not included. The integrated handle 22 is formed integrally within the container and such location includes a flat surface to facilitate painting from the first opening.

It is to be appreciated that the materials and dimensions of container 10 can be selected using sound engineering judgment without departing from the scope of the invention. In an embodiment the first opening 36 can have an inner diameter of approximately 4.35 inches and an outer diameter of 4.8 inches. The height of the collar 88 of the first opening 36 can be approximately 0.8 inches. The second opening 38 can have an inner diameter of approximately 1.425 inches and an outer diameter of 1.545 inches. The height of the lip 86 of the second opening 38 can be approximately 0.524 inches. In this embodiment, the overall height of the container 10 can be approximately 7.9 inches. The length of the second end 13 from integrated handle 22 to the end beneath spout 14 is approximately 6.605 inches. In this embodiment, the handle opening is approximately 3.6 inches high. The handle has a tapered width that is approximately 1.68 inches at the bottom and 1.423 at the top. The handle depth is approximately 1 inch. In this embodiment, the cap 16 has an outside diameter of approximately 1.84 inches, and a height of 0.63 inches. The lid 18 has an outer diameter of approximately 5.16 inches and a side wall 44 height of approximately 1 inch. The overall height of lid 18 including the bottom surface 54 is approximately 1.267 inches.

It is to be appreciated that the lids and/or caps can be used with interchangeably with any container 10 embodiment. For example, any cap shown in FIGS. 21-25 and any lid shown in FIGS. 14-20, 26-30, 31-36, 50-56, 70-77 and 89-96 can be used with containers shown in FIGS. 1-13, 43-49, 57-69, and 78-88. If modification or adjustment is needed to container, lid, or cap, it is to be appreciated that such modification or adjustment can be made with sound engineering judgment without departing from the scope of this subject innovation.

With reference to the drawings, like reference numerals designate identical or corresponding parts throughout the several views. However, the inclusion of like elements in different views does not mean a given embodiment necessarily includes such elements or that all embodiments of the invention include such elements.

The aforementioned elements (e.g., container bodies, lids, among others), and the like have been described with respect to interaction between several components and/or elements. It should be appreciated that such elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the subject matter, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A storage container for storing a material, comprising:

a body having a first end, a second end opposite the first end, a sidewall that connects the first end to the second end, and a thickness for the body such that the body houses a volume;

the body having a front side, a back side opposite the front side, a left side, and a right side opposite the left side, wherein the right side mirrors the left side;

a collar that forms a first opening on the first end;

a lip that forms a second opening on the front side and on the first end, the second opening being smaller than the first opening;

a top of the collar of the first opening is situated on a first geometric plane and a top of the lip of the second opening is situated on a second geometric plane below the first geometric plane such that the first and second geometric planes are parallel to one another;

an integrated handle opposite the second opening on the back side, the integrated handle is formed with an aperture, the aperture separates the integrated handle the body;

the integrated handle lies within a cross-section of the container as defined by the sidewall;

the aperture is orthogonal to a geometric plane in which a center of the first opening, a center of the second opening, and a center of the integrated handle lie;

a front side notch positioned on the front side of the second end and a back side notch opposite the front side notch, the back side notch is positioned on the back side of the second end;

a lid that is configured to removably attach to the first opening;

a cap that is configured to removably attach to the second opening;

the lid includes a handle to move the container while coupled to the first opening.

2. The storage container of claim 1, the integrated handle, the first opening, and the second opening are aligned to one another.

3. The storage container of claim 1, the front side of the first end provides a shape of a front curve.

4. The storage container of claim 3, the back side of the first end includes the integrated handle and provides a shape of a back curve opposite the front curve.

5. The storage container of claim 4, the left side of the first end is rounded in shape and connects between a portion of the back curve to a portion of the front curve.

6. The storage container of claim 5, the right side of the first end is opposite the left side and is rounded in shape to connect between a portion of the back curve to a portion of the front curve.

7. The storage container of claim 6, the front side of the second end provides a shape of a front curve.

8. The storage container of claim 7, the back side of the second end includes the integrated handle and provides a shape of a back curve opposite the front curve.

9. The storage container of claim 8, the left side of the second end is rounded in shape and connects between a portion of the back curve to a portion of the front curve.

10. The storage container of claim 9, the right side of the second end is opposite the left side and is rounded in shape to connect between a portion of the back curve to a portion of the front curve.

11. The storage container of claim 1, the integrated handle further comprising:

a handle top, a handle bottom, grip section in between the handle top and the handle bottom;

the handle top connects with the first end and the handle bottom connects with the second end; and the grip section is rounded in shape and includes a varying diameter from the handle top to the handle bottom.

12. The storage container of claim 11, the handle top includes a first curved portion and a second curved portion opposite thereof for the connection to the first end, and the handle bottom includes a third curved portion and a fourth curved portion opposite thereof for the connection to the second end.

13. The storage container of claim 11, the front side includes a transition section that spans from the second end to the first end in a pyramid shape in which a top of the pyramid is positioned toward the first end and a base of the pyramid is positioned toward the second end, wherein the lip and second opening is positioned on the first end proximate to the top of the pyramid.

14. The storage container of claim 13, the second opening includes threads on a lip to allow removable attachment of a cap, the threads extending at least partially around a perimeter of the lip.

15. The storage container of claim 14, the threads extending non-continuously around the perimeter of the lip such that a gap is formed between the threads in a circumferential direction forming an area free of threads that defines a smooth surface around a center line of the second opening.

16. A storage container for storing a material, comprising:

a body having a first end, a second end opposite the first end, a sidewall that connects the first end to the second end, and a thickness for the body such that the body houses a volume;

the body having a front side, a back side opposite the front side, a left side, and a right side opposite the left side, wherein the right side mirrors the left side;

a collar that forms a first opening on the first end;

a lip that forms a second opening on the front side and on the first end;

a top of the collar of the first opening is situated on a first geometric plane and a top of the lip of the second opening is situated on a second geometric plane below the first geometric plane;

an integrated handle opposite the second opening on the back side, the integrated handle being formed with an aperture that separates the integrated handle from the body and lying within a cross-section of the container as defined by the sidewall;

the integrated handle includes:

a handle top, a handle bottom, and a grip section in between the handle top and the handle bottom;

the handle top connects with the first end and the handle bottom connects with the second end; and the grip section is rounded in shape and includes a varying diameter from the handle top to the handle bottom;

the aperture is orthogonal to a geometric plane in which a center of the first opening, a center of the second opening, and a center of the integrated handle lie;

a front side notch positioned on the front side of the second end and a back side notch opposite the front side notch, the back side notch is positioned on the back side of the second end; and the second end includes an indent feature, wherein the indent feature is recessed into the second end for mating with a corresponding raised feature on a storage container lid.

17. The storage container of claim 16, wherein the indent features is in the form of a channel extending from the left side to the right side for engaging with the corresponding raised feature on the storage container lid of another storage container during stacking.

18. A storage container for storing a coating material, comprising:

a container body that houses a volume, the container body having a first end and a second end opposite the first end, a front side and a back side opposite the front side, and a left side and a right side opposite the left side;

a collar on the first end that forms a first opening on the first end of the container body, wherein a top of the collar is situated on a first geometric plane and wherein the first opening has a first diameter;

a spout that creates a second opening on the first end of the container body, wherein a top of the spout is situated on a second geometric plane below and parallel to the first geometric plane, wherein the second opening has a second diameter less than the first diameter, and wherein a portion of the spout extends in a direction from the rear towards the front of the container body beyond a point where the second end and front side meet;

a built-in handle that is integrated into the container body at a location that is between the first end and the second end and opposite of the spout, the built-in handle is formed from the container body with a pill-shaped aperture that is orthogonal to a geometric plane in which a center of the first opening and a center of the second opening lie;

a lid that is removably coupled via threading to the collar for accessibility to the first opening;

a cap that is removably coupled via threading to a rim of the spout for accessibility to the second opening; and a pail-type handle that is removably coupled to a pair of nodules on the container body, each of the pair of nodules are at a location on the container body perpendicular to the built-in handle.

19. The storage container of claim 18, further comprising a front side notch positioned on a front side of the body proximate the second end and a back side notch opposite the front side notch and positioned on a back side of the container proximate the second end such that the notches define a reduced thickness area proximate the second end.

20. The storage container of claim 18, the first opening having a central axis parallel to a central axis of the second opening.

* * * * *